US009790824B2

(12) United States Patent
Baltrucki et al.

(10) Patent No.: US 9,790,824 B2
(45) Date of Patent: Oct. 17, 2017

(54) LOST MOTION VALVE ACTUATION SYSTEMS WITH LOCKING ELEMENTS INCLUDING WEDGE LOCKING ELEMENTS

(71) Applicant: Jacobs Vehicle Systems, Inc., Bloomfield, CT (US)

(72) Inventors: Justin Baltrucki, Farmington, CT (US); G. Michael Gron, Jr., Granby, CT (US); Kevin Audibert, Wolcott, CT (US); Neil Fuchs, New Hartford, CT (US)

(73) Assignee: JACOBS VEHICLE SYSTEMS, INC., Bloomfield, CT (US)

( * ) Notice: Subject to any disclaimer, the term of this patent is extended or adjusted under 35 U.S.C. 154(b) by 91 days.

(21) Appl. No.: 14/331,982

(22) Filed: Jul. 15, 2014

(65) Prior Publication Data

US 2014/0326212 A1 Nov. 6, 2014

Related U.S. Application Data

(63) Continuation-in-part of application No. 13/192,330, filed on Jul. 27, 2011, now Pat. No. 8,936,006.

(Continued)

(51) Int. Cl.
*F02D 13/04* (2006.01)
*F01L 13/06* (2006.01)

(Continued)

(52) U.S. Cl.
CPC ..... *F01L 13/06* (2013.01); *F01L 1/146* (2013.01); *F01L 1/18* (2013.01); *F01L 1/181* (2013.01);

(Continued)

(58) Field of Classification Search
CPC . F01L 13/06; F01L 13/065; F01L 1/18; F01L 1/24; F01L 1/26; F01L 1/182;

(Continued)

(56) References Cited

U.S. PATENT DOCUMENTS 3,220,392 A 11/1965 Cummins
4,576,128 A 3/1986 Kenichi (Continued)

FOREIGN PATENT DOCUMENTS

CN 101076655 A 11/2007
CN 101142380 A 3/2008

(Continued)

OTHER PUBLICATIONS

Supplementary European Search issued in EP 11 81 31 41 dated May 14, 2014.

(Continued)

*Primary Examiner* — Hai Huynh
*Assistant Examiner* — Gonzalo Laguarda
(74) *Attorney, Agent, or Firm* — Moreno IP Law LLC

(57) ABSTRACT

A system for actuating one or more engine valves comprises a lost motion assembly including locking elements to selectively lock and unlock a locking mechanism disposed within a valve train such that motions may be likewise selectively applied to, or prevented from being applied to, one or more engine valves. In an embodiment, the locking elements comprise wedges having at least one wedge inclined surface defined according to a cone frustum and configured to engage an outer recess formed in a housing, the outer recess comprising an outer recess inclined surface also defined according to the cone frustum. The device may comprise a locking mechanism disposed within a housing bore in the housing and a snubber also disposed in the housing bore. Furthermore, the outer recess may be configured to permit (Continued)

movement of the locking element along a longitudinal axis of the housing bore.

43 Claims, 22 Drawing Sheets

Related U.S. Application Data

(60) Provisional application No. 61/368,248, filed on Jul. 27, 2010.

(51) Int. Cl.

| | |
|---|---|
| ***F01L 1/18*** | (2006.01) |
| ***F02M 26/01*** | (2016.01) |
| ***F01L 1/14*** | (2006.01) |
| *F01L 1/26* | (2006.01) |
| *F01L 1/20* | (2006.01) |

(52) U.S. Cl.
CPC ..... *F01L 13/065* (2013.01); *F02D 13/04* (2013.01); *F02M 26/01* (2016.02); *F01L 1/20* (2013.01); *F01L 1/26* (2013.01); *F01L 2105/00* (2013.01)

(58) Field of Classification Search
CPC . F01L 1/183; F01L 1/146; F01L 1/181; F01L 1/267; F01L 9/02; F01L 2105/00; F02D 13/04
USPC ..... 123/320, 321, 345–348, 90.16, 90.22, 123/90.25, 90.26, 90.39, 90.4, 90.41, 123/90.42, 90.45, 90.46
See application file for complete search history.

(56) References Cited

U.S. PATENT DOCUMENTS

| | | | | |
|---|---|---|---|---|
| 4,592,319 | A | 6/1986 | Meistrick | |
| 4,612,884 | A | 9/1986 | Ajiki | |
| 4,829,948 | A | 5/1989 | Yoshida | |
| 5,388,552 | A | 2/1995 | Sugimoto | |
| 5,537,976 | A | 7/1996 | Hu | |
| 5,553,584 | A | 9/1996 | Konno | |
| 5,619,965 | A | 4/1997 | Cosma | |
| 5,787,859 | A | 8/1998 | Meistrick et al. | |
| 5,809,964 | A | 9/1998 | Meistrick | |
| 5,934,263 | A | 8/1999 | Russ et al. | |
| 5,979,379 | A | 11/1999 | Sato | |
| 6,085,705 | A | 7/2000 | Vorih | |
| 6,189,504 | B1 | 2/2001 | Israel | |
| 6,293,239 | B1 | 9/2001 | Herbst | |
| 6,394,067 | B1 | 5/2002 | Usko | |
| 6,510,824 | B2 | 1/2003 | Vorih et al. | |
| 6,594,996 | B2 | 7/2003 | Yang | |
| 6,694,933 | B1 | 2/2004 | Lester | |
| 6,827,067 | B1 | 12/2004 | Yang | |
| 6,883,492 | B2 | 4/2005 | Vanderpoel et al. | |
| 7,284,533 | B1 | 10/2007 | Huang | |
| 7,509,933 | B2 | 3/2009 | Dingle | |
| 7,565,896 | B1 | 7/2009 | Yang | |
| 7,673,600 | B2 | 3/2010 | Yang | |
| 7,712,449 | B1 | 5/2010 | Schwoerer | |
| 7,909,015 | B2 | 3/2011 | Yang | |
| 8,161,936 | B2 | 4/2012 | Kraft et al. | |
| 8,225,769 | B2 * | 7/2012 | Dilly | F01L 1/26 123/320 |
| 8,550,047 | B2 | 10/2013 | Odell | |
| 8,935,076 | B2 | 1/2015 | Ide | |
| 2003/0221663 | A1 | 12/2003 | Vanderpoel et al. | |
| 2004/0187842 | A1 | 9/2004 | Yang | |
| 2004/0231639 | A1 | 11/2004 | Israel | |
| 2004/0244751 | A1 | 12/2004 | Falkowski | |
| 2005/0016479 | A1 | 1/2005 | Tawa | |
| 2005/0211206 | A1 | 9/2005 | Ruggiero et al. | |
| 2006/0081213 | A1 | 4/2006 | Yang | |
| 2007/0144472 | A1 | 6/2007 | Yang | |
| 2007/0266973 | A1 * | 11/2007 | Lancefield | F01L 1/146 123/90.16 |
| 2008/0230023 | A1 | 9/2008 | Sugiura | |
| 2009/0145390 | A1 | 6/2009 | Morelli | |
| 2010/0006062 | A1 * | 1/2010 | Yang | F01L 1/181 123/321 |
| 2010/0024767 | A1 | 2/2010 | Meneely | |
| 2010/0170472 | A1 * | 7/2010 | Yang | F01L 1/08 123/321 |
| 2010/0307434 | A1 | 12/2010 | Odell | |
| 2011/0203549 | A1 | 8/2011 | Schnell | |
| 2012/0024260 | A1 | 2/2012 | Groth | |
| 2013/0239919 | A1 | 9/2013 | Manther | |
| 2014/0326212 | A1 | 11/2014 | Baltrucki | |

FOREIGN PATENT DOCUMENTS

| | | | |
|---|---|---|---|
| CN | 101270693 | A | 9/2008 |
| CN | 101490393 | A | 7/2009 |
| DE | 19712668 | C1 | 5/1998 |
| EP | 1219792 | A2 | 7/2002 |
| EP | 1857642 | A1 | 11/2007 |
| EP | 2143896 | A1 | 1/2010 |
| EP | 2305967 | A1 | 4/2011 |
| JP | S61252816 | A | 11/1986 |
| JP | H02223613 | A | 9/1990 |
| JP | H07127410 | A | 5/1995 |
| JP | 2668311 | | 10/1997 |
| JP | H10220210 | A | 8/1998 |
| JP | 2000510546 | | 8/2000 |
| JP | 2000510546 | A | 8/2000 |
| JP | 2004060498 | A | 2/2004 |
| JP | 2004360485 | A | 12/2004 |
| JP | 2009024660 | A | 2/2009 |
| JP | 2009138742 | A | 6/2009 |
| JP | 2009526160 | A | 7/2009 |
| JP | 2013527380 | | 6/2013 |
| JP | 2013536347 | | 9/2013 |
| JP | 2013536347 | A | 9/2013 |
| WO | 2004059131 | A2 | 7/2004 |

OTHER PUBLICATIONS

Extended European Search Report filed in Application No. 15175525.3-1603; dated Dec. 14, 2015; 6pgs.
Extended European Search Report in European Application No. 15175525.3 dated Dec. 14, 2015.
English Translation of Office Action in Korean Application No. 10-2015-0071932 dated May 23, 2016.
Fuchs, N., et al., "Development of a High Performance Two-Cycle Engine Brake for Medium and Heavy Duty Diesel Engines," SAE Int. J. Commer. Veh., vol. 6, Issue 1, May 2013.

* cited by examiner

LOST MOTION VALVE ACTUATION SYSTEMS WITH LOCKING ELEMENTS INCLUDING WEDGE LOCKING ELEMENTS

CROSS-REFERENCE TO RELATED APPLICATION

The instant application is a continuation-in-part of co-pending U.S. patent application Ser. No. 13/192,330 filed Jul. 27, 2011 and entitled "Combined Engine Braking And Positive Power Engine Lost Motion Valve Actuation System," which prior application claims priority to U.S. Patent Application Ser. No. 61/368,248, filed Jul. 27, 2010 and entitled "Combined Engine Braking And Positive Power Engine Lost Motion Valve Actuation System," the teachings of which applications are incorporated herein by this reference.

FIELD

The instant disclosure relates generally to systems and methods for actuating one or more engine valves in an internal combustion engine. In particular, embodiments of the instant disclosure relate to systems and methods for valve actuation using a lost motion system.

BACKGROUND

Valve actuation in an internal combustion engine is required in order for the engine to produce positive power, and may also be used to produce auxiliary valve events. During positive power, intake valves may be opened to admit fuel and air into a cylinder for combustion. One or more exhaust valves may be opened to allow combustion gas to escape from the cylinder. Intake, exhaust, and/or auxiliary valves may also be opened during positive power at various times for exhaust gas recirculation (EGR) for improved emissions.

Engine valve actuation also may be used to produce engine braking and brake gas recirculation (BGR) when the engine is not being used to produce positive power. During engine braking, one or more exhaust valves may be selectively opened to convert, at least temporarily, the engine into an air compressor. In doing so, the engine develops retarding horsepower to help slow the vehicle down. This can provide the operator with increased control over the vehicle and substantially reduce wear on the service brakes of the vehicle.

Engine valve(s) may be actuated to produce compression-release braking and/or bleeder braking. The operation of a compression-release type engine brake, or retarder, is well known. As a piston travels upward during its compression stroke, the gases that are trapped in the cylinder are compressed. The compressed gases oppose the upward motion of the piston. During engine braking operation, as the piston approaches the top dead center (TDC), at least one exhaust valve is opened to release the compressed gases in the cylinder to the exhaust manifold, preventing the energy stored in the compressed gases from being returned to the engine on the subsequent expansion down-stroke. In doing so, the engine develops retarding power to help slow the vehicle down. An example of a prior art compression release engine brake is provided by the disclosure of Cummins, U.S. Pat. No. 3,220,392, which is incorporated herein by reference.

The operation of a bleeder type engine brake has also long been known. During engine braking, in addition to the normal exhaust valve lift, the exhaust valve(s) may be held slightly open continuously throughout the remaining engine cycle (full-cycle bleeder brake) or during a portion of the cycle (partial-cycle bleeder brake). The primary difference between a partial-cycle bleeder brake and a full-cycle bleeder brake is that the former does not have exhaust valve lift during most of the intake stroke. An example of a system and method utilizing a bleeder type engine brake is provided by the disclosure of U.S. Pat. No. 6,594,996, which is incorporated herein by reference.

The basic principles of brake gas recirculation (BGR) are also well known. During engine braking the engine exhausts gas from the engine cylinder to the exhaust manifold at a pressure greater than that of the intake manifold. BGR operation allows a portion of these exhaust gases to flow back into the engine cylinder during the intake and/or expansion strokes of the cylinder piston. In particular, BGR may be achieved by opening an exhaust valve when the engine cylinder piston is near bottom dead center position at the end of the intake and/or expansion strokes. This recirculation of gases into the engine cylinder may be used during engine braking cycles to provide significant benefits.

In many internal combustion engines, the engine intake and exhaust valves may be opened and closed by fixed profile cams, and more specifically by one or more fixed lobes or bumps which may be an integral part of each of the cams. Benefits such as increased performance, improved fuel economy, lower emissions, and better vehicle drivability may be obtained if the intake and exhaust valve timing and lift can be varied. The use of fixed profile cams, however, can make it difficult to adjust the timings and/or amounts of engine valve lift to optimize them for various engine operating conditions.

One method of adjusting valve timing and lift, given a fixed cam profile, has been to provide a "lost motion" device in the valve train linkage between the valve and the cam. Lost motion is the term applied to a class of technical solutions for modifying the valve motion proscribed by a cam profile with a variable length mechanical, hydraulic, or other linkage assembly. In a lost motion system, a cam lobe may provide the "maximum" (longest dwell and greatest lift) motion needed over a full range of engine operating conditions. A variable length system may then be included in the valve train linkage, intermediate of the valve to be opened and the cam providing the maximum motion, to subtract or lose part or all of the motion imparted by the cam to the valve.

Some lost motion systems may operate at high speed and be capable of varying the opening and/or closing times of an engine valve from engine cycle to engine cycle. Such systems are referred to herein as variable valve actuation (VVA) systems. VVA systems may be hydraulic lost motion systems or electromagnetic systems. An example of a known VVA system is disclosed in U.S. Pat. No. 6,510,824, which is hereby incorporated by reference.

Engine valve timing may also be varied using cam phase shifting. Cam phase shifters vary the time at which a cam lobe actuates a valve train element, such as a rocker arm, relative to the crank angle of the engine. An example of a known cam phase shifting system is disclosed in U.S. Pat. No. 5,934,263, which is hereby incorporated by reference.

Cost, packaging, and size are factors that may often determine the desirableness of an engine valve actuation system. Additional systems that may be added to existing engines are often cost-prohibitive and may have additional space requirements due to their bulky size. Pre-existing engine brake systems may avoid high cost or additional packaging, but the size of these systems and the number of additional components may often result in lower reliability and difficulties with size. It is thus often desirable to provide an integral engine valve actuation system that may be low cost, provide high performance and reliability, and yet not provide space or packaging challenges.

Embodiments of the systems and methods of the instant disclosure may be particularly useful in engines requiring valve actuation for positive power, engine braking valve events and/or BGR valve events. Some, but not necessarily all, embodiments of the instant disclosure may provide a system and method for selectively actuating engine valves utilizing a lost motion system alone and/or in combination with cam phase shifting systems, secondary lost motion systems, and variable valve actuation systems. Some, but not necessarily all, embodiments of the instant disclosure may provide improved engine performance and efficiency during engine braking operation. Additional advantages of embodiments of the instant disclosure are set forth, in part, in the description which follows and, in part, will be apparent to one of ordinary skill in the art from the description and/or from the practice of teachings described herein.

SUMMARY

Responsive to the foregoing challenges, Applicants have various embodiments of a system for actuating one or more engine valves comprising a lost motion assembly including locking elements to selectively lock and unlock a locking mechanism in a device disposed within a valve train such that motions may be likewise selectively applied to, or prevented from being applied to, one or more engine valves. In an embodiment, the locking elements comprise wedges having at least one wedge inclined surface defined according to a cone frustum and configured to engage an outer recess formed in a housing, the outer recess comprising an outer recess inclined surface also defined according to the cone frustum. In an implementation, the locking mechanism is hydraulically actuated.

In another embodiment, the device comprises an housing, a locking mechanism disposed within an housing bore in the housing and a snubber also disposed in the housing bore.

In yet another embodiment, the outer recess is configured to permit movement of the locking element along a longitudinal axis of the housing bore when the locking element is engaged with the outer recess. According to this embodiment, a vertical height (i.e., a dimension along the longitudinal axis) of the outer recess may be greater than a vertical height of the locking element, and may further be in a range of less than twice the vertical height of the locking element or even greater than twice the vertical height of the locking element.

It is to be understood that both the foregoing general description and the following detailed description are exemplary and explanatory only, and are not restrictive of the invention as claimed.

BRIEF DESCRIPTION OF THE DRAWINGS

In order to assist the understanding of this invention, reference will now be made to the appended drawings, in which like reference characters refer to like elements.

DETAILED DESCRIPTION OF THE PRESENT EMBODIMENTS

Reference will now be made in detail to embodiments of the systems and methods of the instant disclosure, examples of which are illustrated in the accompanying drawings. Embodiments of the instant disclosure include systems and methods of actuating one or more engine valves.

Figure 1:
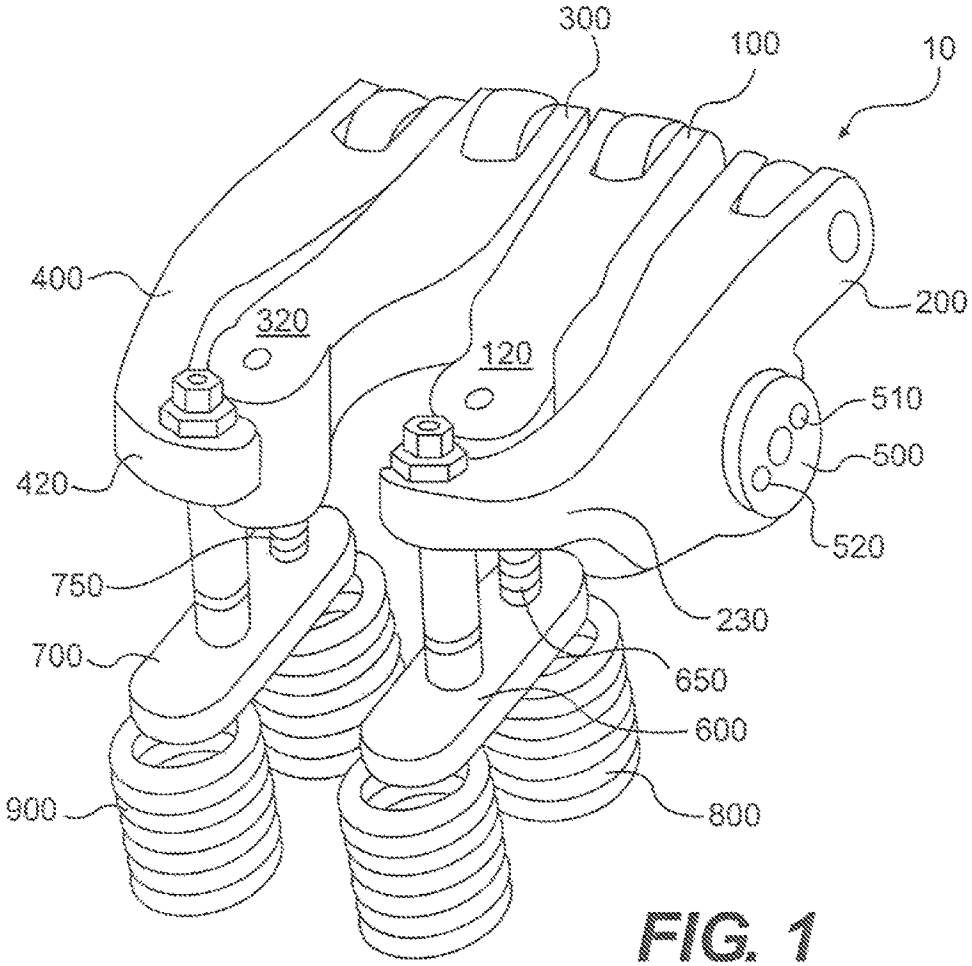
FIG. 1 is a pictorial view of a valve actuation system configured in accordance with a first embodiment of the instant disclosure.

A first embodiment of the instant disclosure is shown in FIG. 1 as valve actuation system 10. The valve actuation system 10 may include a main exhaust rocker arm 200, means for actuating an exhaust valve to provide engine braking 100, a main intake rocker arm 400, and a means for actuating an intake valve to provide engine braking 300. In a preferred embodiment, shown in FIG. 1, the means for actuating an exhaust valve to provide engine braking 100 is an engine braking exhaust rocker arm, referred to by the same reference numeral, and the means for actuating an intake valve to provide engine braking 300 is an engine braking intake rocker arm, referred to by the same reference numeral. The rocker arms 100, 200, 300 and 400 may pivot on one or more rocker shafts 500 which include one or more passages 510 and 520 for providing hydraulic fluid to one or more of the rocker arms.

The main exhaust rocker arm 200 may include a distal end 230 that contacts a center portion of an exhaust valve bridge 600 and the main intake rocker arm 400 may include a distal end 420 that contacts a center portion of an intake valve bridge 700. The engine braking exhaust rocker arm 100 may include a distal end 120 that contacts a sliding pin 650 provided in the exhaust valve bridge 600 and the engine braking intake rocker arm 300 may include a distal end 320 that contacts a sliding pin 750 provided in the intake valve bridge 700. The exhaust valve bridge 600 may be used to actuate two exhaust valve assemblies 800 and the intake valve bridge 700 may be used to actuate two intake valve assemblies 900. Each of the rocker arms 100, 200, 300 and 400 may include ends opposite their respective distal ends which include means for contacting a cam or push tube. Such means may comprise a cam roller, for example.

The cams (described below) that actuate the rocker arms 100, 200, 300 and 400 may each include a base circle portion and one or more bumps or lobes for providing a pivoting motion to the rocker arms. Preferably, the main exhaust rocker arm 200 is driven by a cam which includes a main exhaust bump which may selectively open the exhaust valves during an exhaust stroke for an engine cylinder, and the main intake rocker arm 400 is driven by a cam which includes a main intake bump which may selectively open the intake valves during an intake stroke for the engine cylinder.

Figure 2:
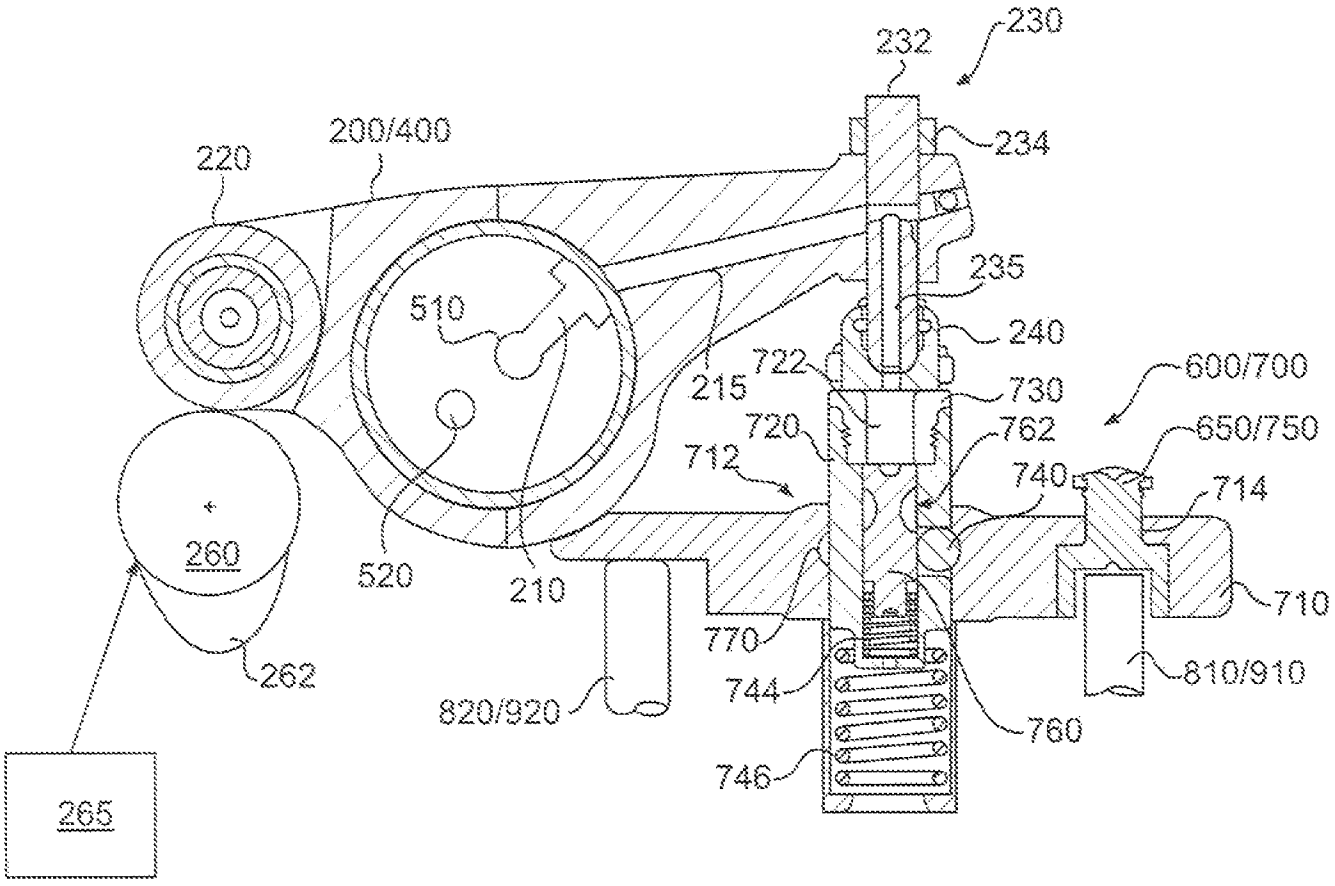
FIG. 2 is a schematic diagram in cross section of a main rocker arm and locking valve bridge configured in accordance with the first embodiment of the instant disclosure.

FIG. 2 illustrates the components of the main exhaust rocker arm 200 and main intake rocker arm 400, as well as the exhaust valve bridge 600 and intake valve bridge 700 in cross section. Reference will be made to the main exhaust rocker arm 200 and exhaust valve bridge 600 because it is appreciated the main intake rocker arm 400 and the intake valve bridge 700 may have the same design and therefore need not be described separately.

With reference to FIG. 2, the main exhaust rocker arm 200 may be pivotally mounted on a rocker shaft 210 such that the rocker arm is adapted to rotate about the rocker shaft 210. A motion follower 220 may be disposed at one end of the main exhaust rocker arm 200 and may act as the contact point between the rocker arm and the cam 260 to facilitate low friction interaction between the elements. The cam 260 may include a single main exhaust bump 262, or for the intake side, a main intake bump. In one embodiment of the instant disclosure, the motion follower 220 may comprise a roller follower 220, as shown in FIG. 2. Other embodiments of a motion follower adapted to contact the cam 260 are considered well within the scope and spirit of the instant disclosure. An optional cam phase shifting system 265 may be operably connected to the cam 260.

Hydraulic fluid may be supplied to the rocker arm 200 from a hydraulic fluid supply (not shown) under the control of a solenoid hydraulic control valve (not shown). The hydraulic fluid may flow through a passage 510 formed in the rocker shaft 210 to a hydraulic passage 215 formed within the rocker arm 200. The arrangement of hydraulic passages in the rocker shaft 210 and the rocker arm 200 shown in FIG. 2 are for illustrative purposes only. Other hydraulic arrangements for supplying hydraulic fluid through the rocker arm 200 to the exhaust valve bridge 600 are considered well within the scope and spirit of the instant disclosure.

An adjusting screw assembly may be disposed at a second end 230 of the rocker arm 200. The adjusting screw assembly may comprise a screw 232 extending through the rocker arm 200 which may provide for lash adjustment, and a threaded nut 234 which may lock the screw 232 in place. A hydraulic passage 235 in communication with the rocker passage 215 may be formed in the screw 232. A swivel foot 240 may be disposed at one end of the screw 232. In one embodiment of the instant disclosure, low pressure oil may be supplied to the rocker arm 200 to lubricate the swivel foot 240.

The swivel foot 240 may contact the exhaust valve bridge 600. The exhaust valve bridge 600 may include a valve bridge body 710 having a central opening 712 extending through the valve bridge and a side opening 714 extending through a first end of the valve bridge. The side opening 714 may receive a sliding pin 650 which contacts the valve stem of a first exhaust valve 810. The valve stem of a second exhaust valve 820 may contact the other end of the exhaust valve bridge.

The central opening 712 of the exhaust valve bridge 600 may receive a lost motion assembly including an outer plunger 720, a cap 730, an inner plunger 760, an inner plunger spring 744, an outer plunger spring 746, and one or more wedge rollers or balls 740. The outer plunger 720 may include an interior bore 22 and a side opening extending through the outer plunger wall for receiving the wedge roller or ball 740. The inner plunger 760 may include one or more recesses 762 shaped to securely receive the one or more wedge rollers or balls 740 when the inner plunger is pushed downward. The central opening 712 of the valve bridge 700 may also include one or more recesses 770 for receiving the one or more wedge rollers or balls 740 in a manner that permits the rollers or balls to lock the outer plunger 720 and the exhaust valve bridge together, as shown. The outer plunger spring 746 may bias the outer plunger 720 upward in the central opening 712. The inner plunger spring 744 may bias the inner plunger 760 upward in outer plunger bore 722.

Hydraulic fluid may be selectively supplied from a solenoid control valve, through passages 510, 215 and 235 to the outer plunger 720. The supply of such hydraulic fluid may displace the inner plunger 760 downward against the bias of the inner plunger spring 744. When the inner plunger 760 is displaced sufficiently downward, the one or more recesses 762 in the inner plunger may register with and receive the one or more wedge rollers or balls 740, which in turn may decouple or unlock the outer plunger 720 from the exhaust valve bridge body 710. As a result, during this "unlocked" state, valve actuation motion applied by the main exhaust rocker arm 200 to the cap 730 does not move the exhaust valve bridge body 710 downward to actuate the exhaust valves 810 and 820. Instead, this downward motion causes the outer plunger 720 to slide downward within the central opening 712 of the exhaust valve bridge body 710 against the bias of the outer plunger spring 746.

Figure 3:
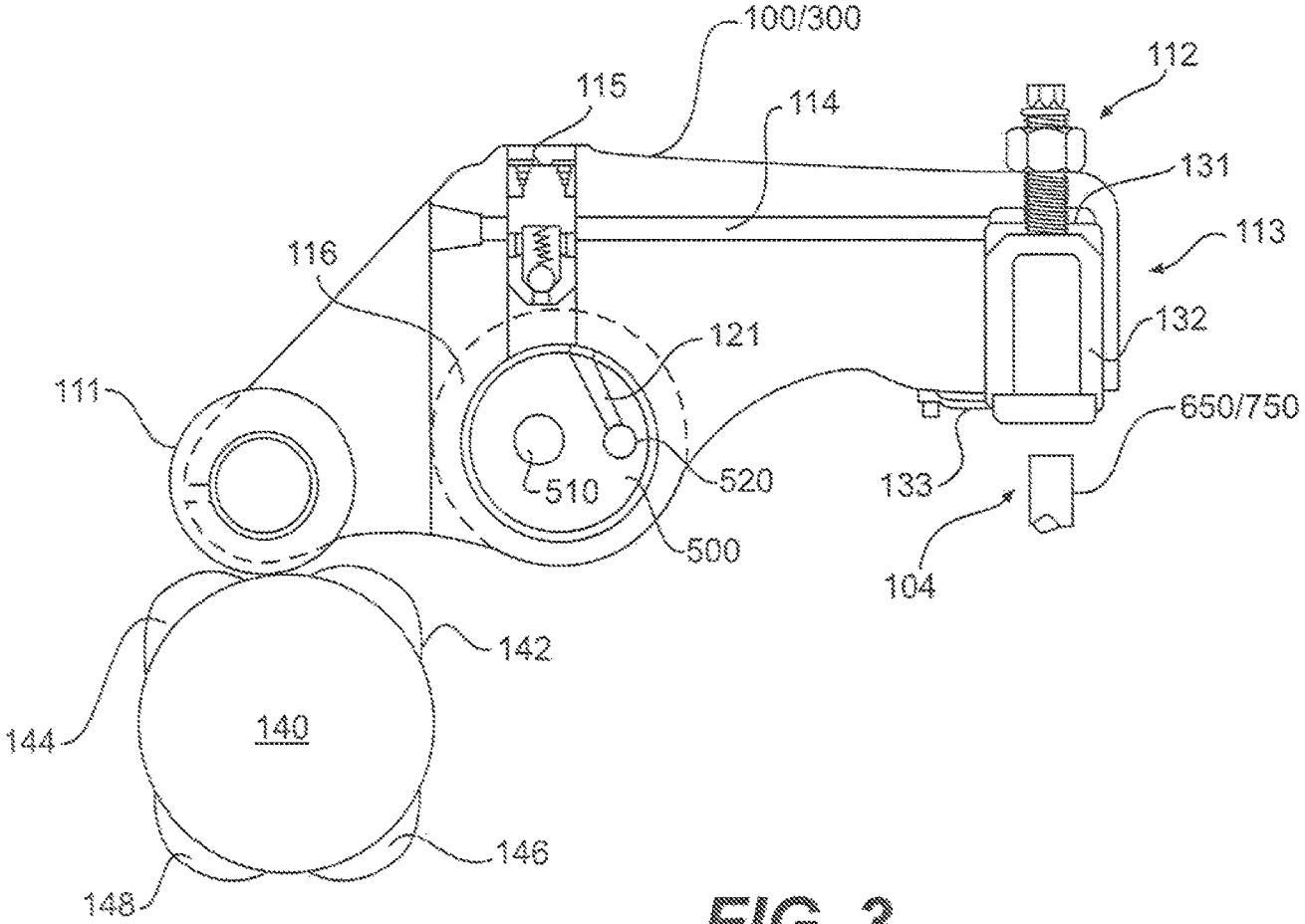
FIG. 3 is a schematic diagram in cross section of an engine braking rocker arm configured in accordance with the first embodiment of the instant disclosure.

With reference to FIGS. 1 and 3, the engine braking exhaust rocker arm 100 and engine braking intake rocker arm 300 may include lost motion elements such as those provided in the rocker arms illustrated in U.S. Pat. Nos. 3,809,033 and 6,422,186, which are hereby incorporated by reference. The engine braking exhaust rocker arm 100 and engine braking intake rocker arm 300 may each have a selectively extendable actuator piston 132 which may take up a lash space 104 between the extendable actuator pistons and the sliding pins 650 and 750 provided in the valve bridges 600 and 700 underlying the engine braking exhaust rocker arm and engine braking intake rocker arm, respectively.

With reference to FIG. 3, the rocker arms 100 and 300 may have the same constituent parts and thus reference will be made to the elements of the exhaust side engine braking rocker arm 100 for ease of description.

A first end of the rocker arm 100 may include a cam lobe follower 111 which contacts a cam 140. The cam 140 may have one or more bumps 142, 144, 146 and 148 to provide compression release, brake gas recirculation, exhaust gas recirculation, and/or partial bleeder valve actuation to the exhaust side engine braking rocker arm 100. When contacting an intake side engine braking rocker arm 300, the cam 140 may have one, two, or more bumps to provide one, two or more intake events to an intake valve. The engine braking rocker arms 100 and 300 may transfer motion derived from cams 140 to operate at least one engine valve each through respective sliding pins 650 and 750.

The exhaust side engine braking rocker arm 100 may be pivotally disposed on the rocker shaft 500 which includes hydraulic fluid passages 510, 520 and 121. The hydraulic passage 121 may connect the hydraulic fluid passage 520 with a port provided within the rocker arm 100. The exhaust side engine braking rocker arm 100 (and intake side engine braking rocker arm 300) may receive hydraulic fluid through the rocker shaft passages 520 and 121 under the control of a solenoid hydraulic control valve (not shown). It is contemplated that the solenoid control valve may be located on the rocker shaft 500 or elsewhere.

The engine braking rocker arm 100 may also include a control valve 115. The control valve 115 may receive hydraulic fluid from the rocker shaft passage 121 and is in communication with the fluid passageway 114 that extends through the rocker arm 100 to the lost motion piston assembly 113. The control valve 115 may be slidably disposed in a control valve bore and include an internal check valve which only permits hydraulic fluid flow from passage 121 to passage 114. The design and location of the control valve 115 may be varied without departing from the intended scope of the instant disclosure. For example, it is contemplated that in an alternative embodiment, the control valve 115 may be rotated approximately 90° such that its longitudinal axis is substantially aligned with the longitudinal axis of the rocker shaft 500.

A second end of the engine braking rocker arm 100 may include a lash adjustment assembly 112, which includes a lash screw and a locking nut. The second end of the rocker arm 100 may also include a lost motion piston assembly 113 below the lash adjuster assembly 112. The lost motion piston assembly 113 may include an actuator piston 132 slidably disposed in a bore 131 provided in the head of the rocker arm 100. The bore 131 communicates with fluid passage 114. The actuator piston 132 may be biased upward by a spring 133 to create a lash space between the actuator piston and the sliding pin 650. The design of the lost motion piston assembly 113 may be varied without departing from the intended scope of the instant disclosure.

Application of hydraulic fluid to the control valve 115 from the passage 121 may cause the control valve to index upward against the bias of the spring above it, as shown in FIG. 3, permitting hydraulic fluid to flow to the lost motion piston assembly 113 through passage 114. The check valve incorporated into the control valve 115 prevents the backward flow of hydraulic fluid from passage 114 to passage 121. When hydraulic fluid pressure is applied to the actuator piston 131, it may move downward against the bias of the spring 133 and take up any lash space between the actuator piston and the sliding pin 650. In turn, valve actuation motion imparted to the engine braking rocker arm 100 from the cam bumps 142, 144, 146 and/or 148 may be transferred to the sliding pin 650 and the exhaust valve 810 below it. When hydraulic pressure is reduced in the passage 121 under the control of the solenoid control valve (not shown), the control valve 115 may collapse into its bore under the influence of the spring above it. Consequently, hydraulic pressure in the passage 114 and the bore 131 may be vented past the top of the control valve 115 to the outside of the rocker arm 100. In turn, the spring 133 may force the actuator piston 132 upward so that the lash space 104 is again created between the actuator piston and the sliding pin 650. In this manner, the exhaust and intake engine braking rocker arms 100 and 300 may selectively provide valve actuation motions to the sliding pins 650 and 750, and thus, to the engine valves disposed below these sliding pins.

Figure 4:
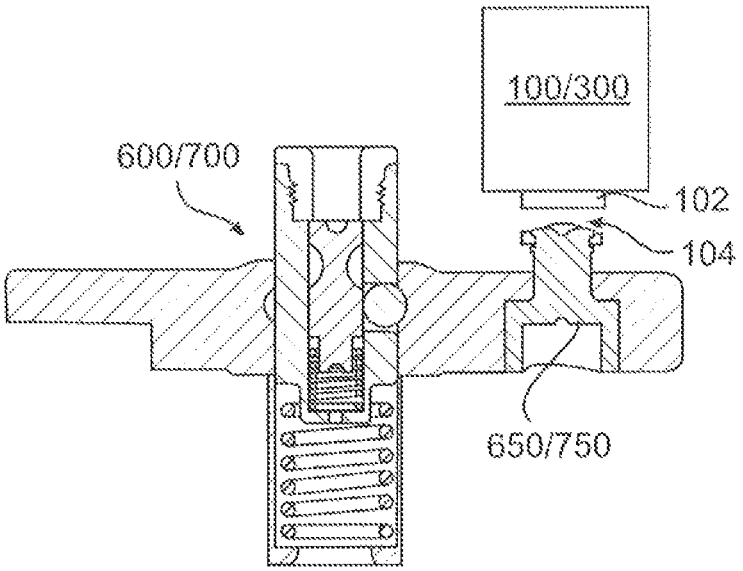
FIG. 4 is a schematic diagram of an alternative engine braking valve actuation means in accordance with an alternative embodiment of the instant disclosure.

With reference to FIG. 4, in another alternative embodiment of the instant disclosure, it is contemplated that the means for actuating an exhaust valve to provide engine braking 100, and/or the means for actuating an intake valve to provide engine braking 300 may be provided by any lost motion system, or any variable valve actuation system, including without limitation, a non-hydraulic system which includes an actuator piston 102. A lash space 104 may be provided between the actuator piston 102 and the underlying sliding pin 650/750, as described above. The lost motion or variable valve actuation system 100/300 may be of any type known to be capable of selectively actuating an engine valve.

The operation of the engine braking rocker arm 100 will now be described. During positive power, the solenoid hydraulic control valve which selectively supplies hydraulic fluid to the passage 121 is closed. As such, hydraulic fluid does not flow from the passage 121 to the rocker arm 100 and hydraulic fluid is not provided to the lost motion piston assembly 113. The lost motion piston assembly 113 remains in the collapsed position illustrated in FIG. 3. In this position, the lash space 104 may be maintained between the lost motion piston assembly 113 and the sliding pin 650/750.

During engine braking, the solenoid hydraulic control valve may be activated to supply hydraulic fluid to the passage 121 in the rocker shaft. The presence of hydraulic fluid within fluid passage 121 causes the control valve 115 to move upward, as shown, such that hydraulic fluid flows through the passage 114 to the lost motion piston assembly 113. This causes the lost motion piston 132 to extend downward and lock into position taking up the lash space 104 such that all movement that the rocker arm 100 derives from the one or more cam bumps 142, 144, 146 and 148 is transferred to the sliding pin 650/750 and to the underlying engine valve.

Figure 5:
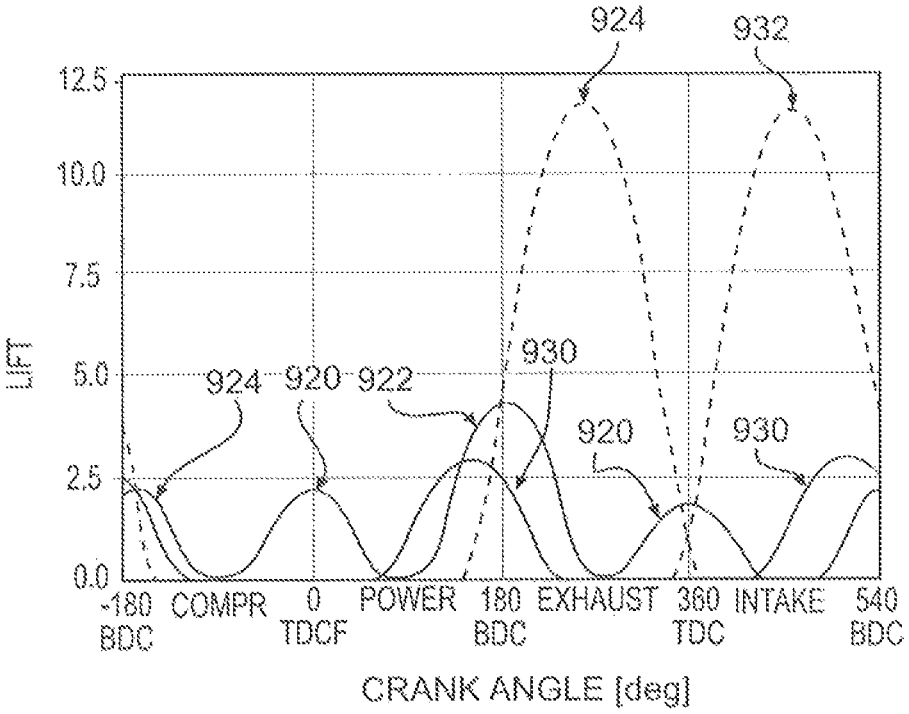
FIG. 5 is a graph illustrating exhaust and intake valve actuations during a two-cycle engine braking mode of operation provided by embodiments of the instant disclosure.

With reference to FIGS. 2, 3 and 5, in a first method embodiment, the system 10 may be operated as follows to provide positive power and engine braking operation. During positive power operation (brake off), hydraulic fluid pressure is first decreased or eliminated in the main exhaust rocker arm 200 and next decreased or eliminated in the main intake rocker arm 400 before fuel is supplied to the cylinder. As a result, the inner plungers 760 are urged into their upper most positions by the inner plunger springs 744, causing the lower portions of the inner plungers to force the one or more wedge rollers or balls 740 into the recesses 770 provided in the walls of the valve bridge bodies 710. This causes the outer plungers 720 and the valve bridge bodies 710 to be "locked" together, as shown in FIG. 2. In turn, the main exhaust and main intake valve actuations that are applied through the main exhaust and main intake rocker arms 200 and 400 to the outer plungers 720 are transferred to the valve bridge bodies 710 and, in turn the intake and exhaust engine valves are actuated for main exhaust and main intake valve events.

During this time, decreased or no hydraulic fluid pressure is provided to the engine braking exhaust rocker arm 100 and the engine braking intake rocker arm 300 (or the means for actuating an exhaust valve to provide engine braking 100 and means for actuating an intake valve to provide engine braking 300) so that the lash space 104 is maintained between each said rocker arm or means and the sliding pins 650 and 750 disposed below them. As a result, neither the engine braking exhaust rocker arm or means 100 nor the engine braking intake rocker arm or means 300 imparts any valve actuation motion to the sliding pins 650 and 750 or the engine valves 810 and 910 disposed below these sliding pins.

During engine braking operation, after ceasing to supply fuel to the engine cylinder and waiting a predetermined time for the fuel to be cleared from the cylinder, increased hydraulic fluid pressure is provided to each of the rocker arms or means 100, 200, 300 and 400. Hydraulic fluid pressure is first applied to the main intake rocker arm 400 and engine braking intake rocker arm or means 300, and then applied to the main exhaust rocker arm 200 and engine braking exhaust rocker arm or means 100.

Application of hydraulic fluid to the main intake rocker arm 400 and main exhaust rocker arm 200 causes the inner plungers 760 to translate downward so that the one or more wedge rollers or balls 740 may shift into the recesses 762. This permits the inner plungers 760 to "unlock" from the valve bridge bodies 710. As a result, main exhaust and intake valve actuation that is applied to the outer plungers 720 is lost because the outer plungers slide into the central openings 712 against the bias of the springs 746. This causes the main exhaust and intake valve events to be "lost."

The application of hydraulic fluid to the engine braking exhaust rocker arm 100 (or means for actuating an exhaust valve to provide engine braking 100) and the engine braking intake rocker arm 300 (or means for actuating an intake valve to provide engine braking 300) causes the actuator piston 132 in each to extend downward and take up any lash space 104 between those rocker arms or means and the sliding pins 650 and 750 disposed below them. As a result, the engine braking valve actuations applied to the engine braking exhaust rocker arm or means 100 and the engine braking intake rocker arm or means 300 are transmitted to the sliding pins 650 and 750, and the engine valves below them.

FIG. 5 illustrates the intake and exhaust valve actuations that may be provided using a valve actuation system 10 that includes a main exhaust rocker arm 200, means for actuating an exhaust valve to provide engine braking 100, a main intake rocker arm 400, and a means for actuating an intake valve to provide engine braking 300, operated as described directly above. The main exhaust rocker arm 200 may be used to provide a main exhaust event 924, and the main intake rocker arm 400 may be used to provide a main intake event 932 during positive power operation.

During engine braking operation, the means for actuating an exhaust valve to provide engine braking 100 may provide a standard BGR valve event 922, an increased lift BGR valve event 924, and two compression release valve events 920. The means for actuating an intake valve to provide engine braking 300 may provide two intake valve events 930 which provide additional air to the cylinder for engine braking. As a result, the system 10 may provide full two-cycle compression release engine braking.

With continued reference to FIG. 5, in a first alternative, the system 10 may provide only one or the other of the two intake valve events 930 as a result of employing a variable valve actuation system to serve as the means for actuating an intake valve to provide engine braking 300. The variable valve actuation system 300 may be used to selectively provide only one or the other, or both intake valve events 930. If only one of such intake valve events is provided, 1.5-cycle compression release engine braking results.

In another alternative, the system 10 may provide only one or the other of the two compression release valve events 920 and/or one, two or none of the BGR valve events 922 and 924 as a result of employing a variable valve actuation system to serve as the means for actuating an exhaust valve to provide engine braking 100. The variable valve actuation system 100 may be used to selectively provide only one or the other, or both compression release valve events 920 and/or none, one or two of the BGR valve events 922 and 924. When the system 10 is configured in this way, it may selectively provide 4-cycle or 2-cycle compression release engine braking with or without BGR.

Figure 6:
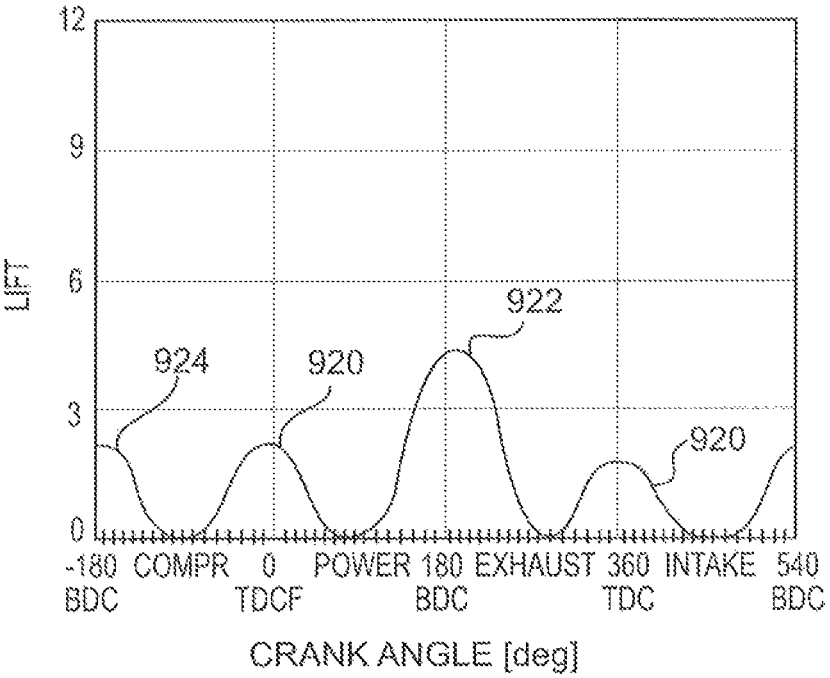
FIG. 6 is a graph illustrating the exhaust valve actuations during a two-cycle engine braking mode of operation provided by embodiments of the instant disclosure.
Figure 7:
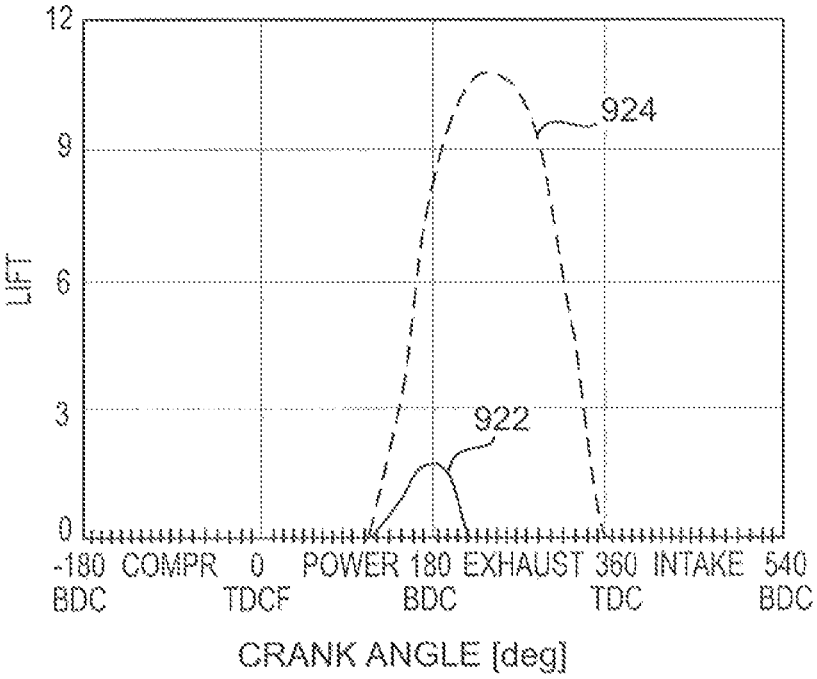
FIG. 7 is a graph illustrating the exhaust valve actuation during a failure mode of operation provided by embodiments of the instant disclosure.

The significance of the inclusion of the increased lift BGR valve event 922, which is provided by having a corresponding increased height cam lobe bump on the cam driving the means for actuating an exhaust valve to provide engine braking 100, is illustrated by FIGS. 6 and 7. With reference to FIGS. 3, 4 and 6, the height of the cam bump that produces the increased lift BGR valve event 922 exceeds the magnitude of the lash space provided between the means for actuating an exhaust valve to provide engine braking 100 and the sliding pin 650. This increased height or lift is evident from event 922 in FIG. 6 as compared with events 920 and 924. During reinstitution of positive power operation using the system 10, it is possible that the exhaust valve bridge 600 will fail to lock to the outer plunger 720, which would ordinarily result in the loss of a main exhaust event 924, which in turn could cause severe engine damage. With reference to FIG. 7, by including the increased lift BGR valve event 922, if the main exhaust event 924 is lost due to a failure, the increased lift BGR valve event 922 will permit exhaust gas to escape from the cylinder near in time to the time that the normally expected main exhaust valve event 924 was supposed to occur, and prevent engine damage that might otherwise result.

Figure 8:
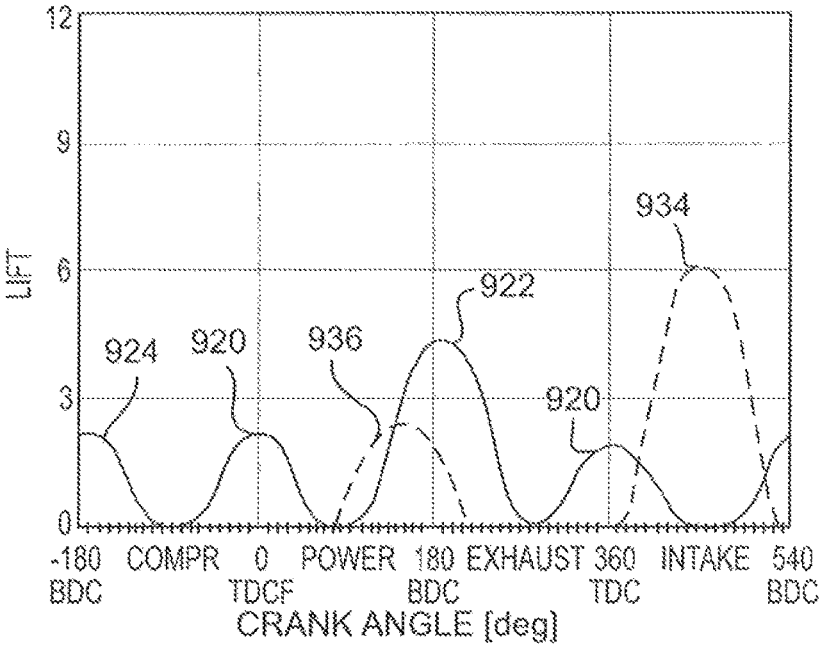
FIG. 8 is a graph illustrating exhaust and intake valve actuations during a two-cycle engine braking mode of operation provided by embodiments of the instant disclosure.

An alternative set of valve actuations, which may be achieved using one or more of the systems 10 describe above, are illustrated by FIG. 8. With reference to FIG. 8, the system used to provide the exhaust valve actuations 920, 922 and 924 are the same as those described above, and the manner of actuating the main exhaust rocker arm 200 and the engine braking exhaust rocker arm 100 (FIG. 3) or means for actuating an exhaust valve to provide engine braking 100 (FIG. 4) are also the same. The main intake rocker arm 400 and manner of operating it are similarly the same as in the previous embodiments.

With continued reference to FIG. 8, one, or the other, or both of the intake valve events 934 and/or 936 may be provided using one of three alternative arrangements. In a first alternative, the means for actuating an intake valve to provide engine braking 300, whether provided as rocker arm or otherwise, may be eliminated from the system 10. With additional reference to FIG. 2, in place of means 300, an optional cam phase shifting system 265 may be provided to operate on the cam 260 driving the main intake rocker arm 400. The cam phase shifting system 265 may selectively modify the phase of the cam 260 with respect to the crank angle of the engine. As a result, with reference to FIGS. 2 and 8, the intake valve event 934 may be produced from the main intake cam bump 262. The intake valve event 934 may be "shifted" to occur later than it ordinarily would occur. Specifically, the intake valve event 934 may be retarded so as not to interfere with the second compression release valve event 920. Intake valve event 936 may not be provided when the cam phase shifting system 265 is utilized, which results in 1.5-cycle compression release engine braking.

Instituting compression release engine braking using a system 10 that includes a cam phase shifting system 265 may occur as follows. First, fuel is shut off to the engine cylinder in question and a predetermined delay is provided to permit fuel to clear from the cylinder. Next, the cam phase shifting system 265 is activated to retard the timing of the main intake valve event. Finally, the exhaust side solenoid hydraulic control valve (not shown) may be activated to supply hydraulic fluid to the main exhaust rocker arm 200 and the means for actuating an exhaust valve to provide engine braking 100. This may cause the exhaust valve bridge body 710 to unlock from the outer plunger 720 and disable main exhaust valve events. Supply of hydraulic fluid to the means for actuating an exhaust valve to provide engine braking 100 may produce the engine braking exhaust valve events, including one or more compression release events and one or more BGR events, as explained above. This sequence may be reversed to transition back to positive power operation starting from an engine braking mode of operation.

With reference to FIGS. 4 and 8, in second and third alternatives, one, or the other, or both of the intake valve events 934 and/or 936 may be provided by employing a lost motion system or a variable valve actuation system to serve as the means for actuating an intake valve to provide engine braking 300. A lost motion system may selectively provide both intake valve events 934 and 936, while a variable valve actuation system may selectively provide one, or the other, or both intake valve events 934 and 936.

Instituting compression release engine braking using a system 10 that includes a hydraulic lost motion system or hydraulic variable valve actuation system may occur as follows. First, fuel is shut off to the engine cylinder in question and a predetermined delay is incurred to permit fuel to clear from the cylinder. Next, the intake side solenoid hydraulic control valve may be activated to supply hydraulic fluid to the main intake rocker arm 400 and the intake valve bridge 700. This may cause the intake valve bridge body 710 to unlock from the outer plunger 720 and disable main intake valve events. Finally, the exhaust side solenoid hydraulic control valve may be activated to supply hydraulic fluid to the main exhaust rocker arm 200 and the means for actuating an exhaust valve to provide engine braking 100. This may cause the exhaust valve bridge body 710 to unlock from the outer plunger 720 and disable the main exhaust valve event. Supply of hydraulic fluid to the means for actuating an exhaust valve to provide engine braking 100 may produce the desired engine braking exhaust valve events, including one or more compression release valve events 920, and one or more BGR valve events 922 and 924, as explained above. This sequence may be reversed to transition back to positive power operation starting from an engine braking mode of operation.

Figure 9:
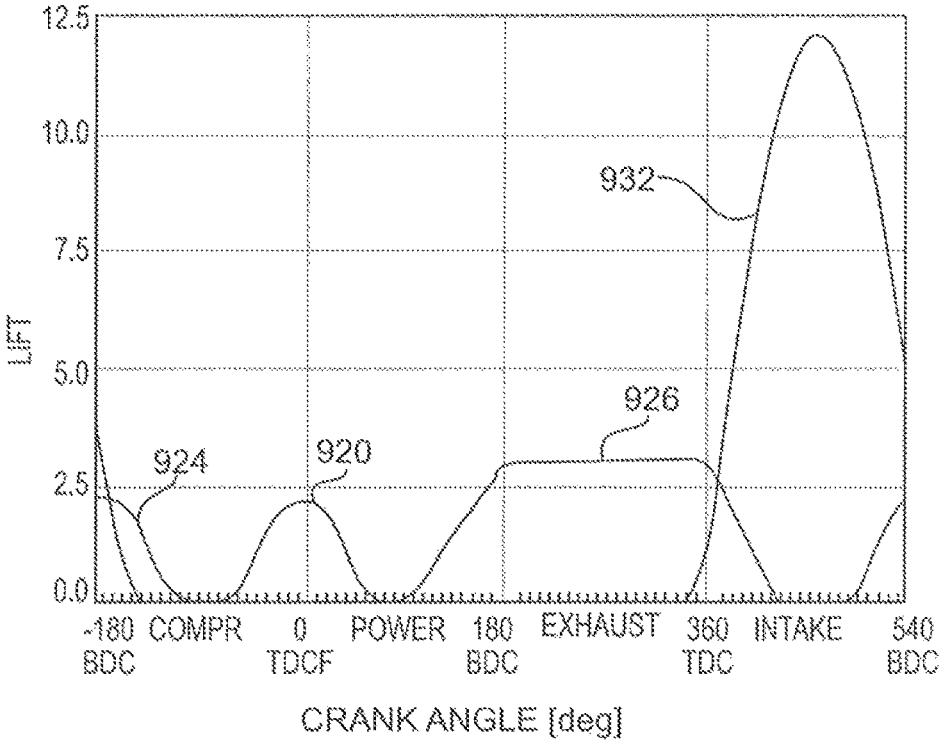
FIG. 9 is a graph illustrating exhaust and intake valve actuations during a two-cycle compression release and partial bleeder engine braking mode of operation provided by embodiments of the instant disclosure.

Another alternative to the methods described above is illustrated by FIG. 9. In FIG. 9 all valve actuations shown are the same as described above, and may be provided using any of the systems 10 described above, with one exception. Partial bleeder exhaust valve event 926 (FIG. 9) replaces BGR valve event 922 and compression release valve event 920 (FIGS. 5 and 8). This may be accomplished by including a partial bleeder cam bump on the exhaust cam in place of the two cam bumps that would otherwise produce the BGR valve event 922 and the compression release valve event 920.

It is also appreciated that any of the foregoing discussed embodiments may be combined with the use of a variable geometry turbocharger, a variable exhaust throttle, a variable intake throttle, and/or an external exhaust gas recirculation system to modify the engine braking level achieved using the system 10. In addition, the engine braking level may be modified by grouping one or more valve actuation systems 10 in an engine together to receive hydraulic fluid under the control of a single solenoid hydraulic control valve. For example, in a six cylinder engine, three sets of two intake and/or exhaust valve actuation systems 10 may be under the control of three separate solenoid hydraulic control valves, respectively. In such a case, variable levels of engine braking may be provided by selectively activating the solenoid hydraulic control valves to provide hydraulic fluid to the intake and/or exhaust valve actuation systems 10 to produce engine braking in two, four, or all six engine cylinders.

The embodiments described above, particularly the embodiment illustrated in FIG. 2, concern a particular embodiment of a lockable, lost motion assembly disposed within a specific component of a valve train (i.e., within the valve bridge 600/700) such that motion may be selectively applied to one or more engine valves. In the above-described embodiments, the lockable, lost motion assembly was disposed within a particular form of an housing bore, specifically a central opening 712. Further embodiments of a lockable, lost motion assembly, which may be disposed within other components of a valve train, are described below. Additionally, the embodiment described above concerns a lockable, lost motion assembly in which locking capability is provided by a locking element comprising a ball. Alternative locking elements are set forth in the various embodiments described below.

Referring now to FIGS. 10-19, a second alternative embodiment of a valve bridge 600/700 is illustrated, in which like reference characters refer to like elements. It is noted that the embodiments shown in FIGS. 10-19 may be operated in like fashion to those illustrated in FIGS. 1-9, however, the embodiments of FIGS. 10-19 are not considered to be limited to providing engine braking. The embodiments of FIGS. 10-19 may provide any type of engine valve actuation that benefits from inclusion of a lost motion system. The embodiments of FIGS. 10-19 differ from those of FIGS. 1-9 at least in part as a result of the use of one or more wedge-shaped locking elements, described in detail below.

Figure 10:
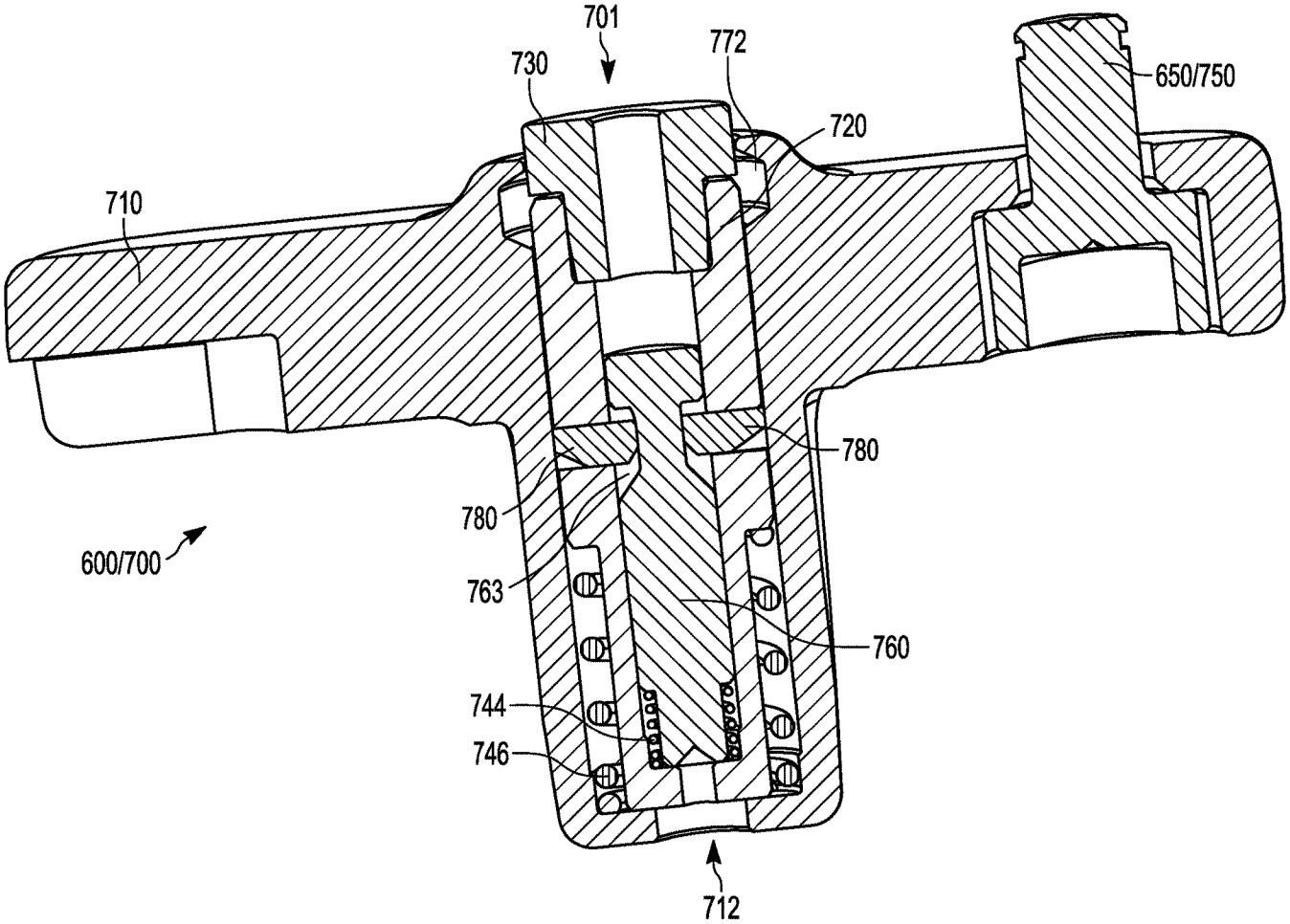
FIG. 10 is a schematic diagram in cross section of a decoupling engine valve bridge or engine braking valve actuation means in a locked position in accordance with a second alternative embodiment of the instant disclosure.

With reference to FIG. 10, the valve bridge 600/700 may include a valve bridge body (or, more generally, a housing) 710 having a housing bore 712 extending through the valve bridge and a side opening 714 extending through a first end of the valve bridge. Generally, the housing bore 712 may extend through the housing at any point along the length thereof, i.e., it is not necessary that the housing bore 712 be disposed as a centrally-positioned bore, though such centrally-positioned bores may be desirable in many circumstances. The side opening 714 may receive a sliding pin 650/750 which contacts the valve stem of a first engine valve (shown in FIG. 2). The valve stem of a second exhaust valve (shown in FIG. 2) may contact the other end of the exhaust valve bridge.

The housing bore 712 may receive a lockable, lost motion assembly 701 including, in the illustrated embodiment, an outer plunger 720, a cap 730, an inner plunger 760, an inner plunger spring 744, an outer plunger spring 746, and one or more locking elements 780. The outer plunger spring 746 may bias the outer plunger 720 upward in the housing bore 712. The inner plunger spring 744 may bias the inner plunger 760 upward in the outer plunger bore. The outer plunger 720 may include openings extending through the sidewall of the outer plunger in which one or more locking elements 780 are disposed. The openings are of sufficient size to permit the locking elements 780 to freely slide back and forth (i.e., radially) therein.

Figure 12:
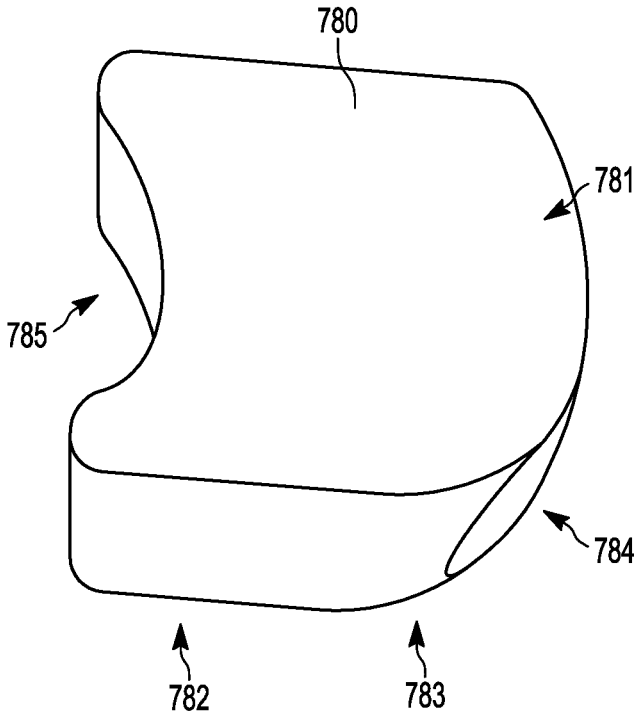
FIG. 12 is a first pictorial view of a wedge locking element used in the second alternative embodiment of the instant disclosure.
Figure 13:
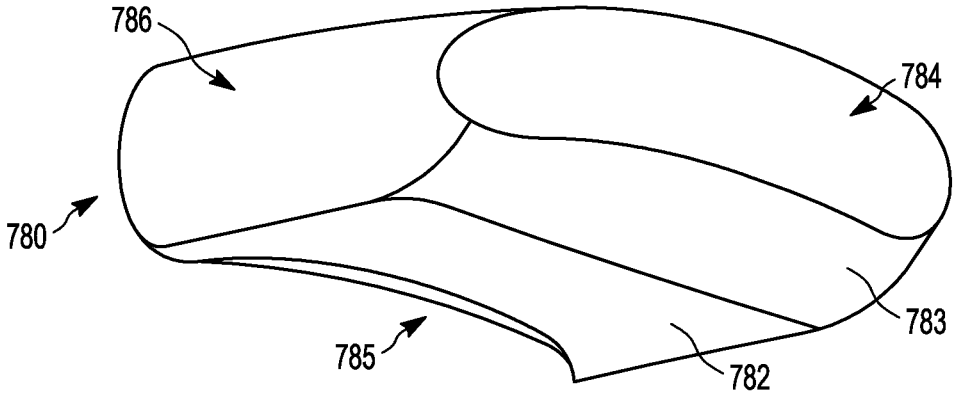
FIG. 13 is a second pictorial view of a wedge locking element used in the second alternative embodiment of the instant disclosure.

In an embodiment, the locking elements 780 may comprise wedges having specific features. With reference now to FIGS. 12 and 13, the wedges 780 may have a substantially flat top surface 781, a flat bottom surface 782, a wedge inclined surface 783, a convex outer face 784, a concave inner face 785, and rounded side edges 786. Preferably, the flat top surface 781 and the flat bottom surface 782 are substantially parallel (i.e., within fabrication tolerances) to each other. As described in further detail below, the wedge 780 permits elements of the lockable, lost motion assembly 701 to be locked together (i.e., in a locked state in which the elements are generally, though not necessarily entirely, immobile relative to each other) such that motions may be transmitted through the lost motion assembly 701 to one or more engine valves. As such, the wedges 780 are required to withstand substantial forces supplied by a motion source (e.g., cam) and transmitted by a valve train. The flat top 781 of each wedge 780 permits these forces to be spread out over a larger surface area, thereby lowering the pressures experienced by any given point on wedge 780. As a result, the wedges 780 are less like to wear out or experience premature failure.

Figure 14:
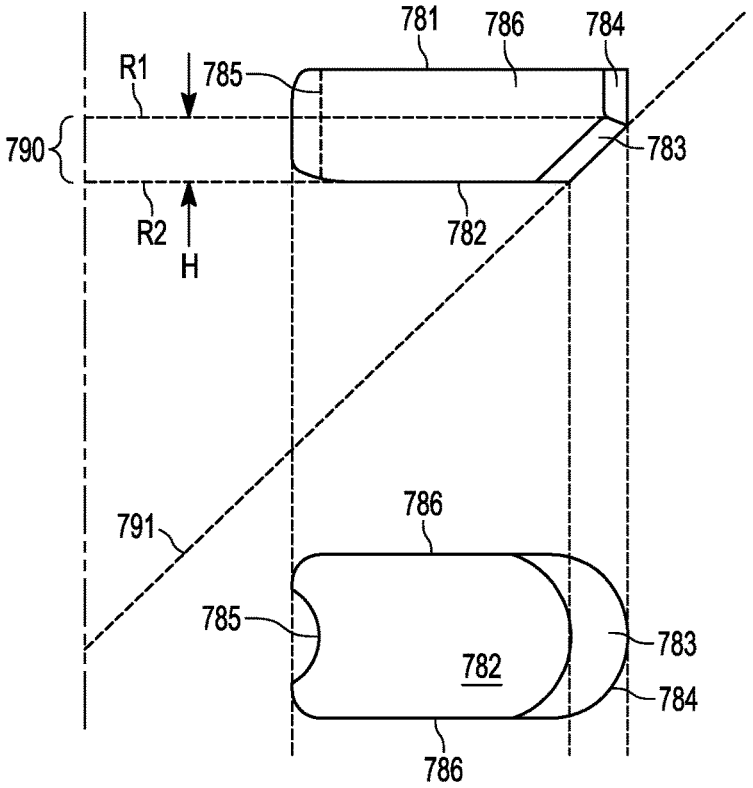
FIG. 14 illustrates side and bottom views of a wedge locking element in accordance with the instant disclosure.

Another feature of each wedge 780 is the wedge inclined surface 783, which, as described below, cooperates with an outer recess inclined surface 773 formed in a surface defining the housing bore 712. In a presently preferred embodiment, the wedge inclined surface 783 is defined according to a cone (or conic) frustum, as further illustrated in FIG. 14. In particular, FIG. 14 illustrates a side and bottom view of the wedge 780 illustrated in FIGS. 12 and 13, and further illustrates how the wedge inclined surface 783 is defined according to a cone frustum 790 that, in turn, is defined according to a cone 791. As known in the art, the cone frustum 790 is that volume defined by parallel planes, R1, R2, intersecting the cone 791 perpendicular to the cone's central axis and separated by a distance, H. Note that the distance, H, defining the cone frustum 790 may extend up to the full thickness (or height) of the wedge 780, in which case the convex outer face 784 could be reduced to an edge between the flat top surface 781 and the wedge inclined surface 783. As shown in the side view of FIG. 14 (top), the wedge inclined surface 783 has an angle relative to the central axis of the cone defined by the surface of the cone. Likewise, as best shown in the bottom view of FIG. 14 (bottom), the wedge inclined surface 783 is curved along its entire length, which curve follows the curvature of that portion of the cone 791 intercepted by the width (i.e., the distance between the side edges 786) of the wedge 780. In the illustrated embodiment, the surfaces of both the convex outer face 784 and concave inner face 785 are substantially parallel (i.e., within fabrication tolerances) to the central axis of the cone, though this is not a requirement. The particular dimensions of the wedge 780, including its thickness (or vertical height), width, length, wedge inclined surface angle, etc. may be selected as a matter of design choice.

Figure 15:
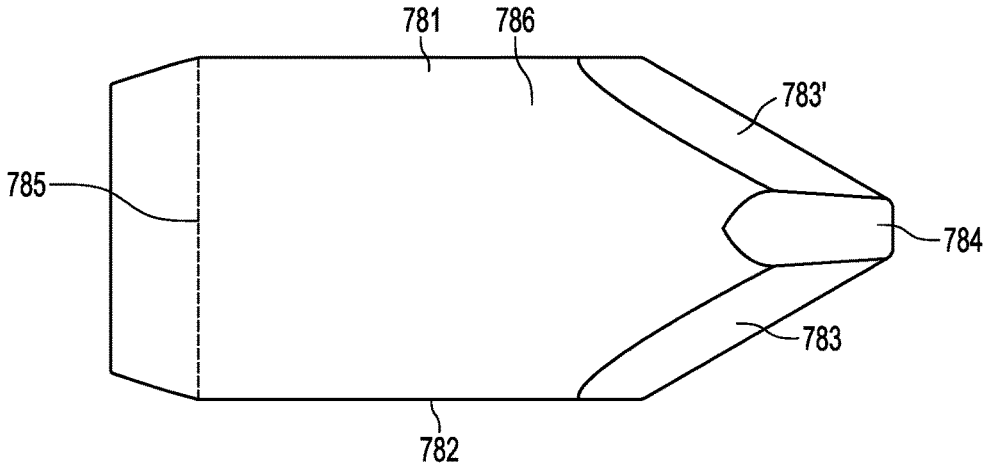
FIG. 15 illustrates a side view of an alternative wedge locking element in accordance with the instant disclosure.

In an alternative embodiment, each wedge 780 may be formed to include not only the wedge inclined surface 783, but also a second wedge inclined surface 783', as shown in FIG. 15. In particular, the second wedge inclined surface 783' may be disposed on a side of the wedge 780 opposite that side of the wedge upon which the first wedge inclined surface 783 is disposed. Thus, in the illustrated example, the first wedge inclined surface 783 is disposed on the flat bottom surface 782 and the second wedge inclined surface 783' is disposed on the flat top surface 781. As further shown, the second wedge inclined surface 783 mirrors the first wedge inclined surface 783 relative to a plane, substantially parallel to the flat top surface 781 and flat bottom surface 782 and bisecting the thickness (or height) of the wedge therebetween. The embodiment of the wedge 780 illustrated in FIG. 15 is particularly advantageous for manufacturing purposes. Because the second wedge inclined surface 783' is an essentially identical, mirrored replica of the first wedge inclined surface 783, dependence upon orientation of the wedge 780 (i.e., flat top surface 781 or flat bottom surface 782 facing upward) during manufacturing is reduced.

Figure 11:
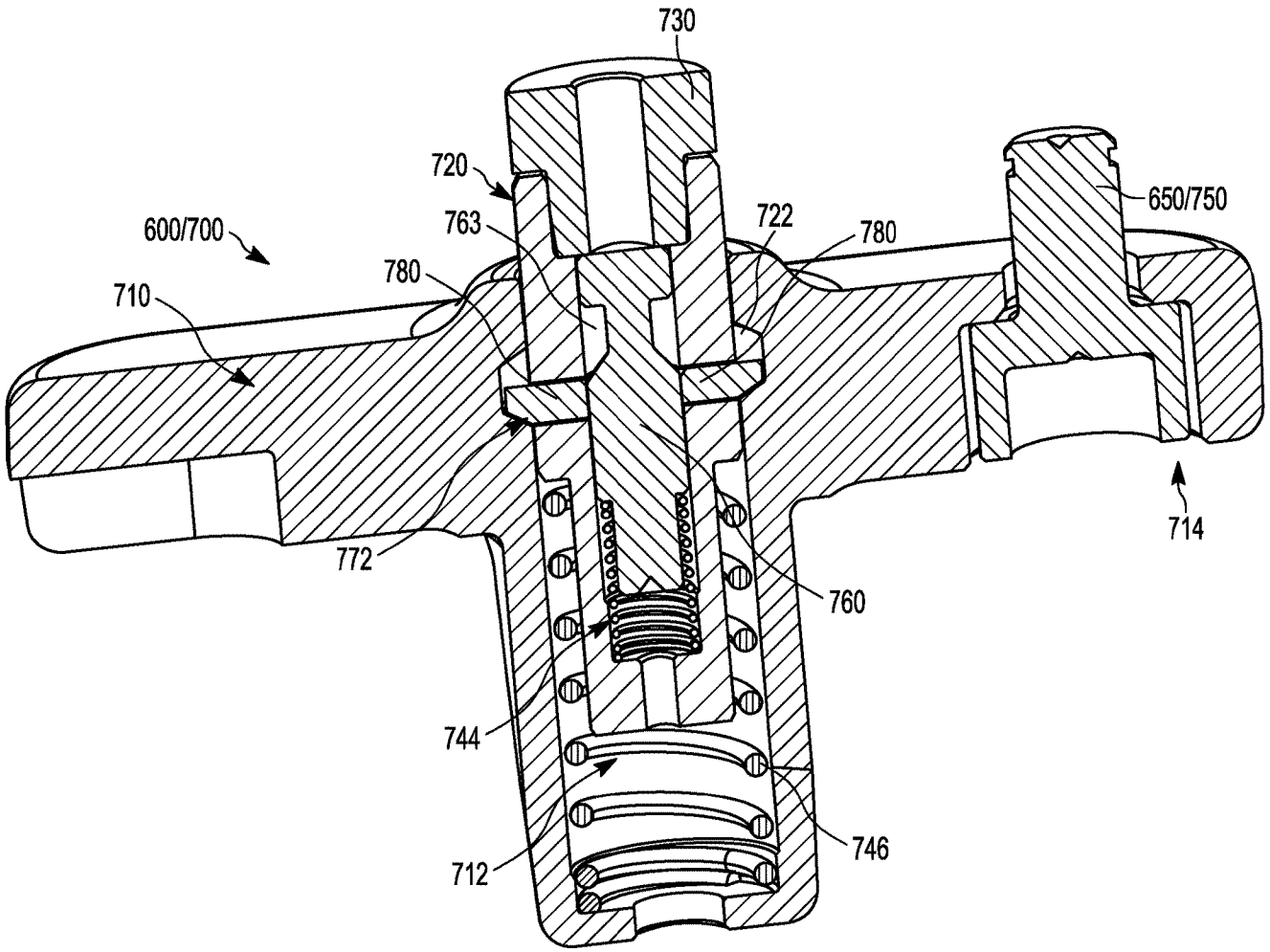
FIG. 11 is a schematic diagram in cross section of a decoupling engine valve bridge or engine braking valve actuation means in an unlocked position in accordance with the second alternative embodiment of the instant disclosure.

In the embodiment illustrated in FIGS. 10 and 11, an outer recess 772 is defined in a surface 779 defining the housing bore 712. In an embodiment, the outer recess 772 is formed as an annular channel around the entire circumference of the surface 779 defining the housing bore 712. This annular configuration of the outer recess 772 permits the outer plunger 720 (and, consequently, the locking elements 780) to rotate freely within the housing bore 712 without loss of operation of the locking mechanism. This also facilitates even wear along the housing bore 712 and outer recess 772. When the locking element(s) 780 are engaged with the outer recess 772 as shown, for example, in FIGS. 11 and 18, the outer plunger 720 and the housing 710 are effectively locked together.

Figure 16:
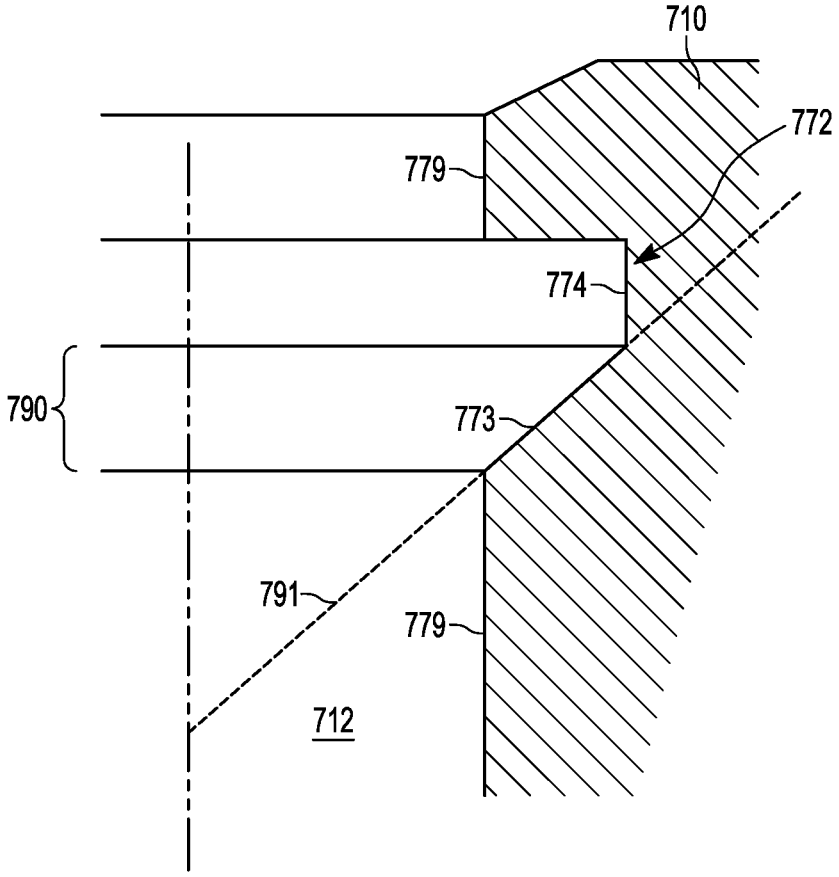
FIGS. 16 and 17 illustrate an housing having an outer recess in accordance with the instant disclosure.
Figure 17:
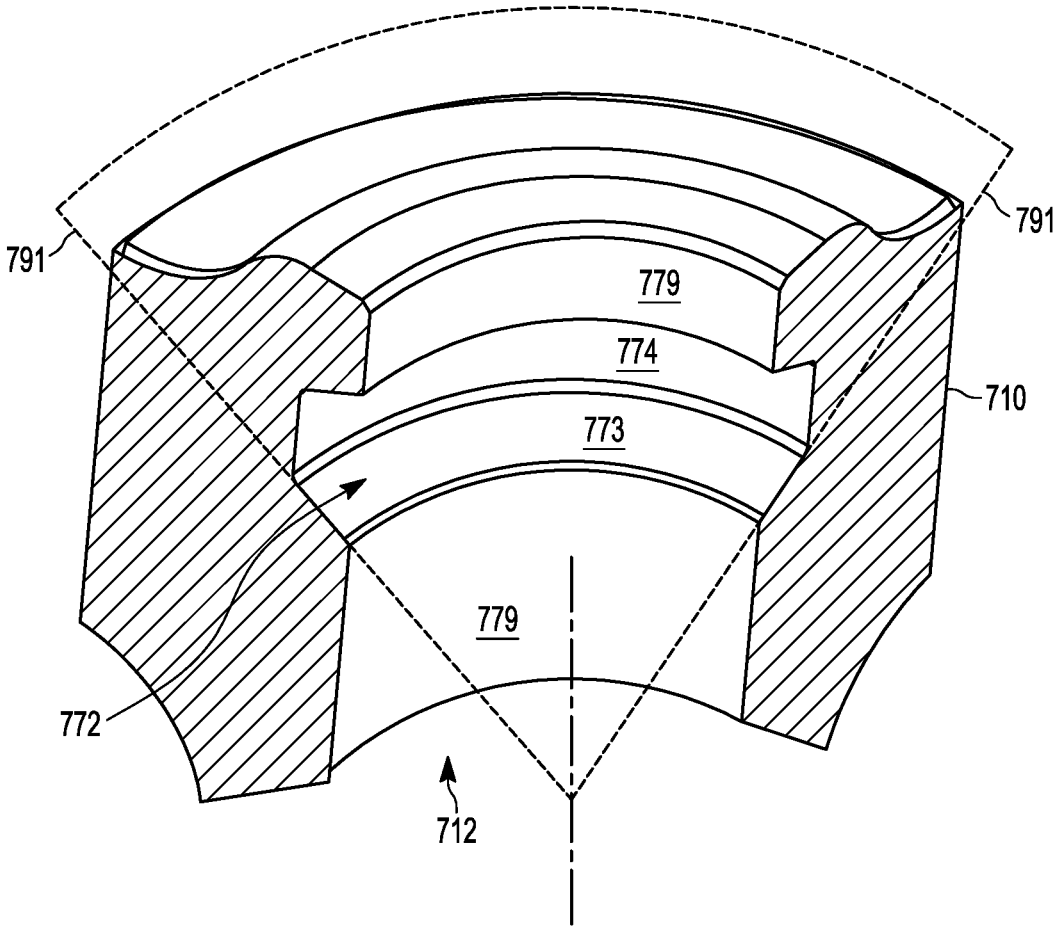

With reference now to FIGS. 16 and 17, the outer recess 772 further comprises an outer recess inclined surface 773 that, like the wedge inclined surface 783, is defined according to the cone 791 and cone frustum 790. Thus, the outer recess inclined surface 783 has, like the wedge inclined surface 783, substantially the same angle (i.e., within fabrication tolerances) relative to the central axis of the cone 791 defined by the surface of the cone 791. Given the illustrated alignment of the inclined surfaces 773, 783, when the outer plunger 720 is pushed downward, interaction of the inclined surfaces 773, 783 urges the locking elements 780 radially inward, thereby permitting unlocking of the outer plunger 720 from the housing 710. Preferably, the central axis of the cone 791 substantially aligns (i.e., within fabrication tolerances) with a longitudinal axis of the housing bore 712, as shown in FIG. 17. The complementary configuration of the wedge inclined surface 783 and the outer recess inclined surface 773 permits substantially continuous engagement therebetween, which in turn allows applied loads to be spread out over a larger area.

Figure 18:
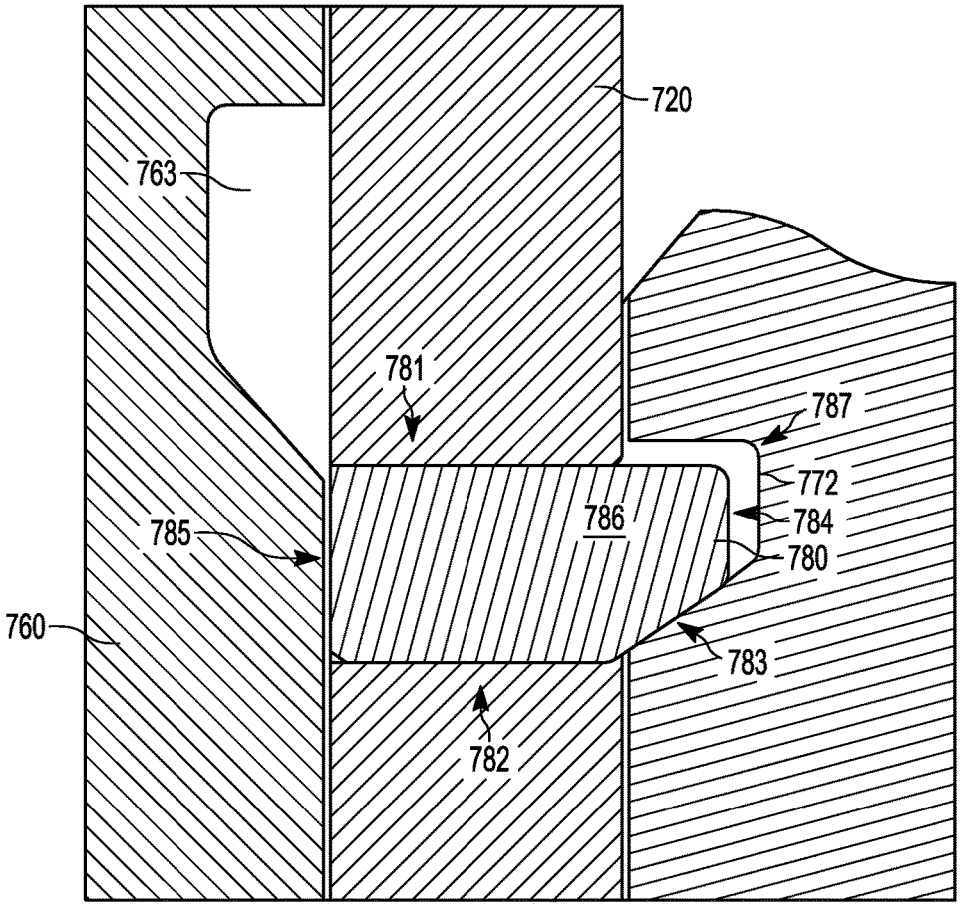
FIG. 18 is an enlarged schematic diagram in cross section of the wedge locking element used in the second alternative embodiment of the instant disclosure.
Figure 19:
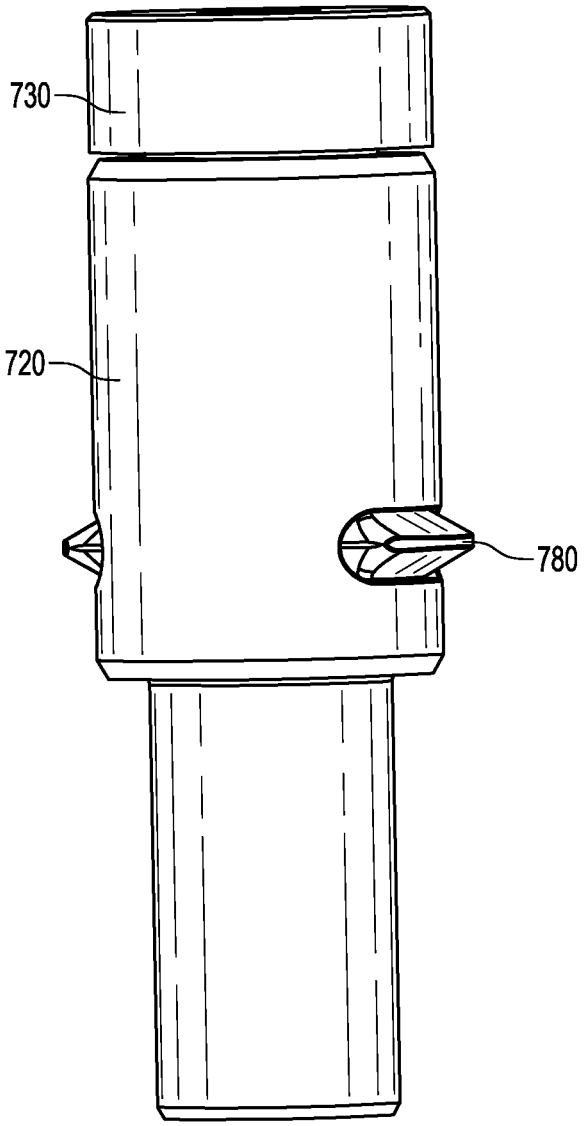
FIG. 19 is a pictorial view of selected elements of the second alternative embodiment of the instant disclosure.

As further shown in FIGS. 16-18, the outer recess 772 further comprises a back surface or wall 774 extending substantially parallel to the longitudinal axis of the housing bore 712 from the terminal point of the outer recess inclined surface 773. In an embodiment, the back surface 774 is located at a radial depth (relative to the surface 779 defining the housing bore 712) at least sufficient to permit most, if not all, of the wedge inclined surface 783 to mate with the outer recess inclined surface 773. Furthermore, the back surface 774 should have a vertical height (i.e., along the longitudinal axis of the housing bore 712) sufficient to permit movement of the locking element 780, beyond fabrication tolerances, in the direction of the longitudinal axis of the housing bore 712 when the locking element 780 is mated with the outer recess 772 (i.e., in a locked state). This is illustrated in FIG. 18 where the vertical height of the back surface 774 is selected to provide a gap 787 between an upper surface of the outer recess 772 and the locking element 780. The gap 787 may facilitate locking of the outer plunger 720 to the housing 710 when a motion source (e.g., a cam) for valve actuation (not shown) is not providing motion to the valve (e.g., on base circle). When no motion is being provided to the valve, there should be little or no load on the locking elements 780 to prevent their radially outward travel to engage the outer recess 772. The gap 787 is preferably sized to at least equal (or accommodate) warm lash on the engine. Furthermore, the gap 787 may be sized to allow sufficient longitudinal motion of the outer plunger 720 to compensate for movement of the housing 710. For example, where the housing 710 is embodied by a valve bridge, the valve bridge may tilt during braking lift, which could cause disconnect of the housing 710 with the oil supply provided by the e-foot of the rocker arm. In this case, the longitudinal motion of the locking member 780 is desirable to prevent such disconnection, which could otherwise cause oil losses and potential re-locking of the inner plunger 760.

As illustrated in FIGS. 10, 11 and 18, the inner plunger 760 may include an inner recess 763 shaped to securely receive the locking element(s) 780 when the inner plunger 760 is pushed downward. In an embodiment, the inner recess 763 is formed as an annular channel around the entire circumference of the inner plunger 760. Furthermore, the inner recess 763 is configured to be sufficiently deep as to permit the full refraction of the locking member(s) 780 out of the outer recess 772. As shown, the inner recesses 763 may have inclined surfaces that permit the locking elements 780 to slide progressively into the inner recess 763 when the inner plunger 760 is displaced downward (e.g., by hydraulic pressure). In those embodiments in which the locking elements 780 are in the form of the wedges illustrated in FIGS. 12-15, a radius of the concave inner face 785 of the wedge is selected to substantially conform (i.e., within fabrication tolerances) to the outer surface of the inner plunger 760 defined by the inner recess 763.

With renewed reference to FIG. 10, hydraulic fluid may be selectively supplied as unlocking input from a solenoid control valve, through passages 510, 215 and 235 (see FIG. 2) to an unlocking opening in the outer plunger 720. In the illustrated embodiment, the unlocking opening is the open end 731 of the outer plunger 720 extending out of the housing 710. The supply of hydraulic fluid may displace the inner plunger 760 downward against the bias of the inner plunger spring 744. When the inner plunger 760 is displaced sufficiently downward, the one or more recesses 763 in the inner plunger may register with and receive the one or more locking elements 780, which in turn may decouple or unlock the outer plunger 720 from the housing 710, as shown in FIG. 10. As a result, during this unlocked state, valve actuation motion applied by the main rocker arm 200 (see FIG. 2) to the cap 730 does not move the valve bridge body 710 downward to actuate the engine valves. Instead, this downward motion causes the outer plunger 720 to slide downward within the housing bore 712 of the valve bridge body 710 against the bias of the outer plunger spring 746. While the unlocking input in the illustrated example is hydraulic fluid provided through the unlocking opening, it is appreciated that the unlocking input may be provided in the form of a mechanical input (e.g., a rod, piston, etc.), a pneumatic input or any combination of thereof.

When it is desired to relock the outer plunger 720 to the housing 710, the unlocking input may be removed or another, locking input may be provided. In the illustrated example, this is accomplished by decreasing or eliminating the hydraulic fluid pressure in the passages 510, 215 and 235 (see FIG. 2). As a result, the inner plunger 760 is urged into its upper most position by the inner plunger spring 744, causing the lower portion of the inner plunger to force the one or more locking elements 780 through the side openings in the outer plunger side wall (see FIG. 19) into the outer recess 772 when the locking elements 780 align with the outer recess 772. This causes the outer plunger 720 and the housing 710 to be locked together, as shown in FIG. 10. In turn, the valve actuations that are applied through the rocker arm to the outer plunger 720 are transferred to the housing 710 and, in turn, the engine valves are actuated for valve events.

During this time (i.e., when the locking mechanism is in the locked state), decreased or no hydraulic fluid pressure is provided to the rocker arm (or the means for actuating an engine valve) 100/300 that overlies the sliding pin 650/750 so that the lash space 104 (see FIG. 4) is maintained between this rocker arm or means and the sliding pin 650/750 disposed below it. As a result, the rocker arm 100/300 does not impart any valve actuation motion to the sliding pin 650/750 or the engine valves disposed below these sliding pins.

Figure 20:
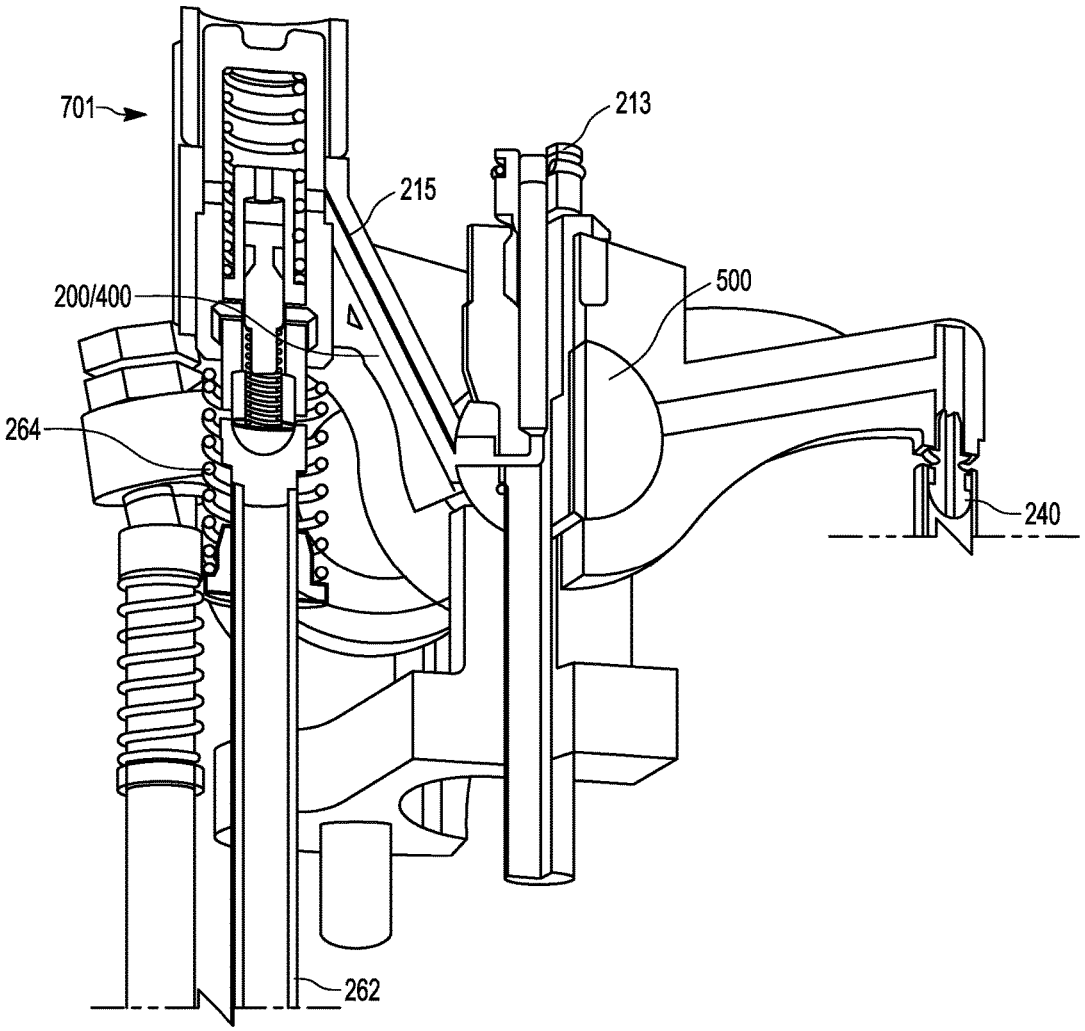
FIG. 20 is a pictorial view in partial cut-away illustrating a third alternative embodiment of the instant disclosure.
Figure 22:
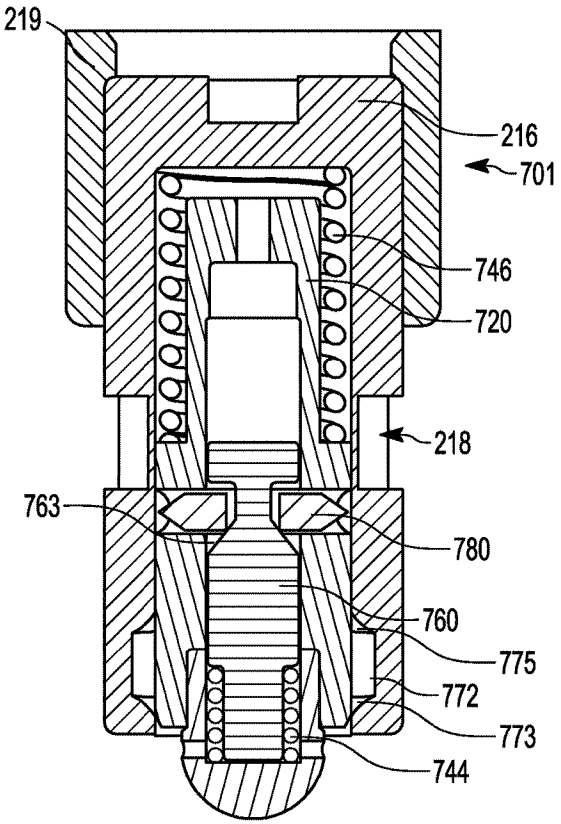
FIGS. 21 and 22 are schematic diagrams in cross section of the lost motion system shown in FIG. 20.
Figure 21:
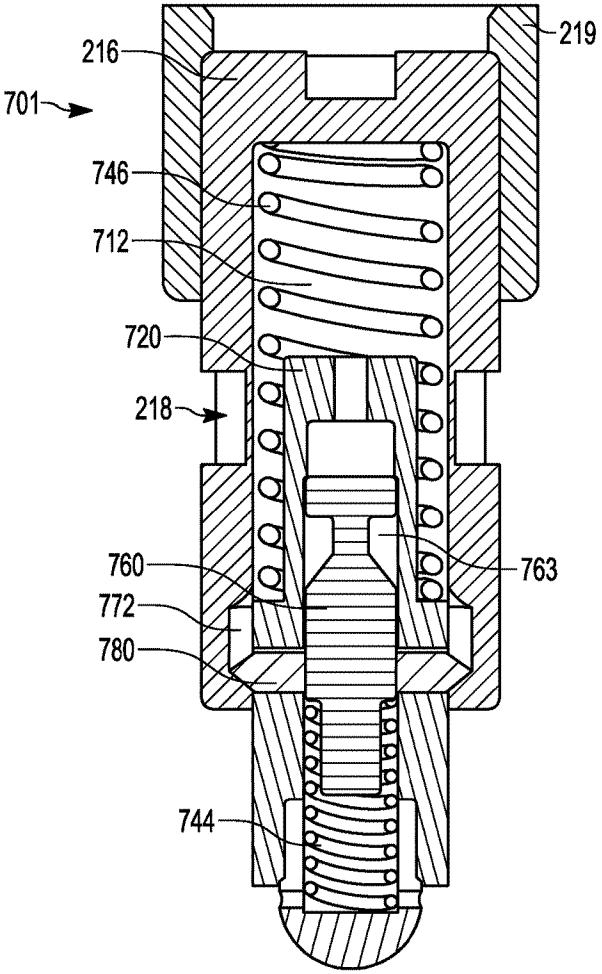

A third alternative embodiment of a lost motion assembly 701 incorporating locking elements is illustrated in FIGS. 20-22, in which like reference characters refer to like elements in other embodiments. It is noted that the embodiments shown in FIGS. 20-22 may be operated in like fashion to those illustrated in FIGS. 1-19, none of the embodiments of which are considered to be limited to providing engine braking. The embodiments of FIGS. 20-22 may provide any type of engine valve actuation that benefits from inclusion of a lost motion system.

With reference to FIGS. 20-22, the lost motion assembly 701 may be provided in a rocker arm 200/400 provided on a rocker shaft 500 supported by a rocker pedestal. The rocker arm 200/400 may have a swivel foot 240 disposed at a first end for actuating one or more engine valves (not shown). The rocker arm 200/400 may include internal passages 215 for receiving hydraulic fluid from a hydraulic fluid supply 213. The internal passages 215 may communicate with the lost motion assembly 701 through side or lateral openings 218 (serving as the unlocking opening for receiving unlocking input, as described below) provided in the housing 216.

In this embodiment, the housing 216 may be mounted in an opening provided in the rocker arm 200/400 above a push tube 262 (or other valve train element, such as a cam, etc.). A locking nut 219 may be used to secure the housing 216 to the rocker arm. The housing 216 may having a housing bore 712 extending vertically through the housing, and side openings 218 communicating with the housing bore. In this embodiment, hydraulic fluid is used as unlocking input and may be selectively provided to the housing 216 through the side openings 218.

The housing bore 712 of the housing 216 may receive a lost motion assembly 701 including an outer plunger 720, an inner plunger 760, an inner plunger spring 744, an outer plunger spring 746, and one or more locking elements 780, once again implemented as wedges. The outer plunger spring 746 may bias the outer plunger 720 downward in the housing bore 712. The inner plunger spring 744 may bias the inner plunger 760 upward in the outer plunger bore. The outer plunger 720 may include openings extending through the sidewall of the outer plunger in which the wedges 780 are disposed. The openings are of sufficient size to permit the wedges 780 to slide back and forth in them freely. In the illustrated embodiment, the wedges 780 are of the type having two, oppositely disposed wedge inclined surfaces as illustrated in FIG. 15.

As will be readily apparent through comparison of the embodiment of FIGS. 10 and 11 with the embodiment of FIGS. 20-22, a significant distinction is the relative configuration of the inner and outer plungers 760, 720 and their corresponding springs 744, 746. Generally, in all embodiments described herein, the outer plunger spring 746 is deployed such that it applies a bias force to the outer plunger 720 in opposition to the valve motion source (e.g., cam, rocker arm, push tube, etc.), whereas the inner plunger spring 744 is deployed such that it applies a bias force to the inner plunger 760 in opposition to the unlocking input (e.g., hydraulic fluid). Consequently, in the embodiment illustrated in FIGS. 20-22, the outer plunger spring 744 is arranged above the outer plunger 720 to the extent that the valve motion source in this embodiment (i.e., the push tube 262) is arranged below the outer plunger 720.

As in the embodiment of FIGS. 10 and 11, the housing 216 may include an outer recess 772 for receiving the wedges 780, as described above. In this embodiment, the outer recess 772 not only includes an outer recess inclined surface 773 as described above, but may also include an outer recess upper inclined surface 775, which surfaces urge the wedges 780 inward when the outer plunger 720 is pushed downward or upward on them, respectively. As before, the outer recess inclined surface 773 is sufficiently large to support the high loads required to open the engine valves serviced by the rocker arm 200/400. As shown in FIGS. 20-22, the outer plunger recesses 772 may also optionally have a vertical dimension that is greater than that of the wedges 780.

As described above, the inner plunger 760 may include an inner recess 763 shaped to securely receive the wedges 780 when the inner plunger is pushed downward, as shown in FIG. 22. The recesses 763 may have inclined surfaces designed to permit the wedges 780 to slide progressively into the recesses when the inner plunger 760 is displaced downward by hydraulic pressure applied from passages 215.

In operation, hydraulic fluid may be provided as unlocking input through the passage 215 in the rocker arm 200/400 to an annular region formed in the bore in the rocker arm that receives the housing 216, which annular region is arranged to align with the side openings 218. Thus, when hydraulic fluid is supplied to the passage 215, it is permitted to flow through the side openings 218 into an interior region of the housing 216, which is closed at its upper end. Consequently, the hydraulic fluid will flow through an upper opening of the outer plunger 720 and into the outer plunger bore, thereby causing the inner plunger 760 to move downward against the bias of the inner plunger spring 744. As described above, this downward movement of the inner plunger 760 permits the wedges 780 to be received in the inner recess 763 of the inner plunger 760, thereby unlocking the outer plunger 760 from the housing 216 (see FIG. 22).

An advantage of the housing 216 and lost motion assembly 701 shown in FIGS. 20-22 is that they can be manufactured as a cartridge insert for insertion into any of a number of valve train elements, such as rocker arms (as shown) and push tubes, provided that such valve train elements are configured to have an appropriately dimensioned opening to receive the cartridge insert and to supply hydraulic fluid as described above.

Figure 23:
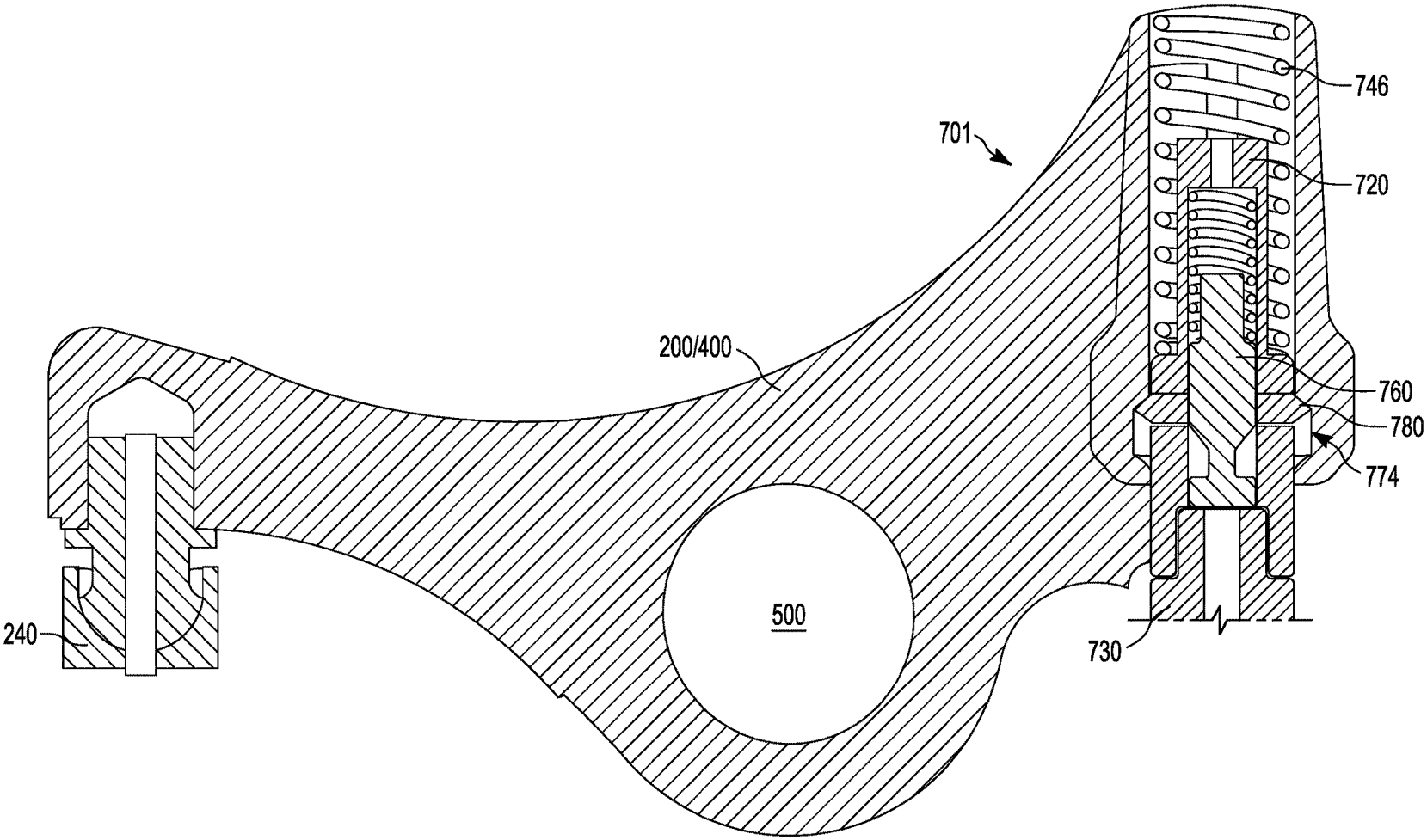
FIG. 23 is a schematic diagram in cross section illustrating a fourth alternative embodiment of the instant disclosure, as provided in rocker arm.
Figure 24:
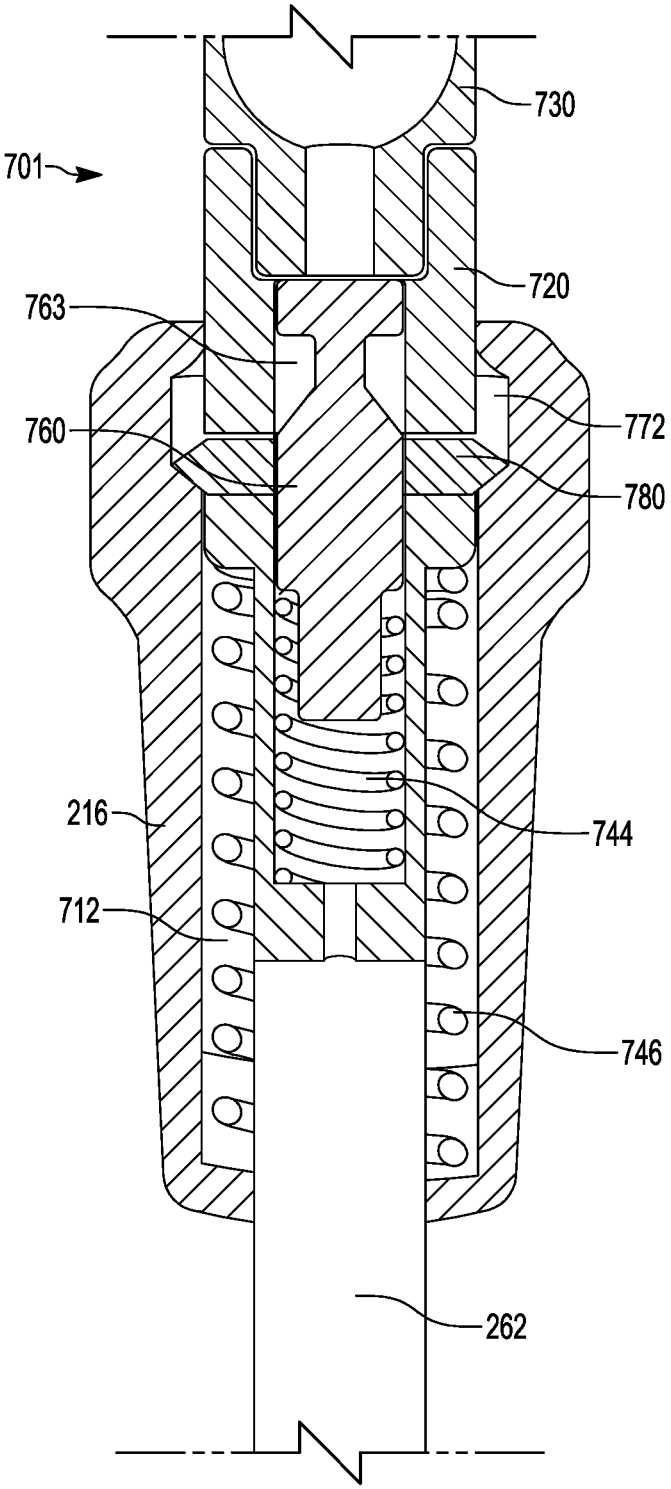
FIG. 24 is a schematic diagram in cross section illustrating the lost motion system shown in FIG. 23 as mounted on a push-tube.

A fourth alternative embodiment of a lost motion assembly 701 incorporating wedges is illustrated in FIGS. 23 and 24, in which like reference characters refer to like elements in other embodiments. FIGS. 23 and 24 differ only in the orientation of the lost motion assembly 701 and the manner of mounting it in the valve train. As shown in FIGS. 23 and 24, the lost motion assembly 701 in FIG. 23 is inverted relative to the lost motion system in FIG. 24. Further, the lost motion systems in FIG. 23 is mounted within a rocker arm 200/400 while the lost motion system in FIG. 24 is provided at the end of a push tube 262. The operation and assembly of the FIGS. 23 and 24 embodiments are sufficiently alike that only one description is provided for both. It is also noted that the embodiments shown in FIGS. 23 and 24 may be operated in like fashion to those illustrated in FIGS. 1-22, none of the embodiments of which are considered to be limited to providing engine braking. The embodiments of FIGS. 23 and 24 may provide any type of engine valve actuation that benefits from inclusion of a lost motion system.

With reference to FIGS. 23 and 24, the lost motion assembly 701 may be provided in a housing 216 mounted (as in the case of a cartridge insert) in a rocker arm 200/400 or push tube 262. Alternatively, the housing 216 may be integrally formed in the body of the rocker arm 200/400 or push tube 262. Hydraulic fluid may be selectively supplied to the lost motion assembly 701 through an opening provided in a cap 730. The embodiments shown in FIGS. 23 and 24 differ from those shown in FIGS. 20-22 mainly in the manner that the unlocking input (e.g., hydraulic fluid) is supplied to the systems. In FIGS. 23 and 24, hydraulic fluid is supplied through the cap 730 while in FIGS. 20-22 it is supplied through side passages 218.

With continued reference to FIGS. 23 and 24, the housing bore 712 of the housing 216 may receive a lost motion assembly 701 including an outer plunger 720, an inner plunger 760, an inner plunger spring 744, an outer plunger spring 746, and one or more locking elements 780, illustrated in these embodiments as wedges similar to those illustrated in FIG. 15. The outer plunger spring 746 may bias the outer plunger 720 downward in the housing bore 712, as shown in FIG. 23 (or in the opposite direction as shown in FIG. 24). The inner plunger spring 744 may bias the inner plunger 760 downward in the outer plunger bore, as shown in FIG. 23 (or in the opposite direction as shown in FIG. 24). The outer plunger 720 may include openings extending through the sidewall of the outer plunger in which the wedges 780 are disposed. Operation of the embodiments shown in FIGS. 23 and 24 is essentially the same as those embodiments shown in FIGS. 20-22.

Figure 25:
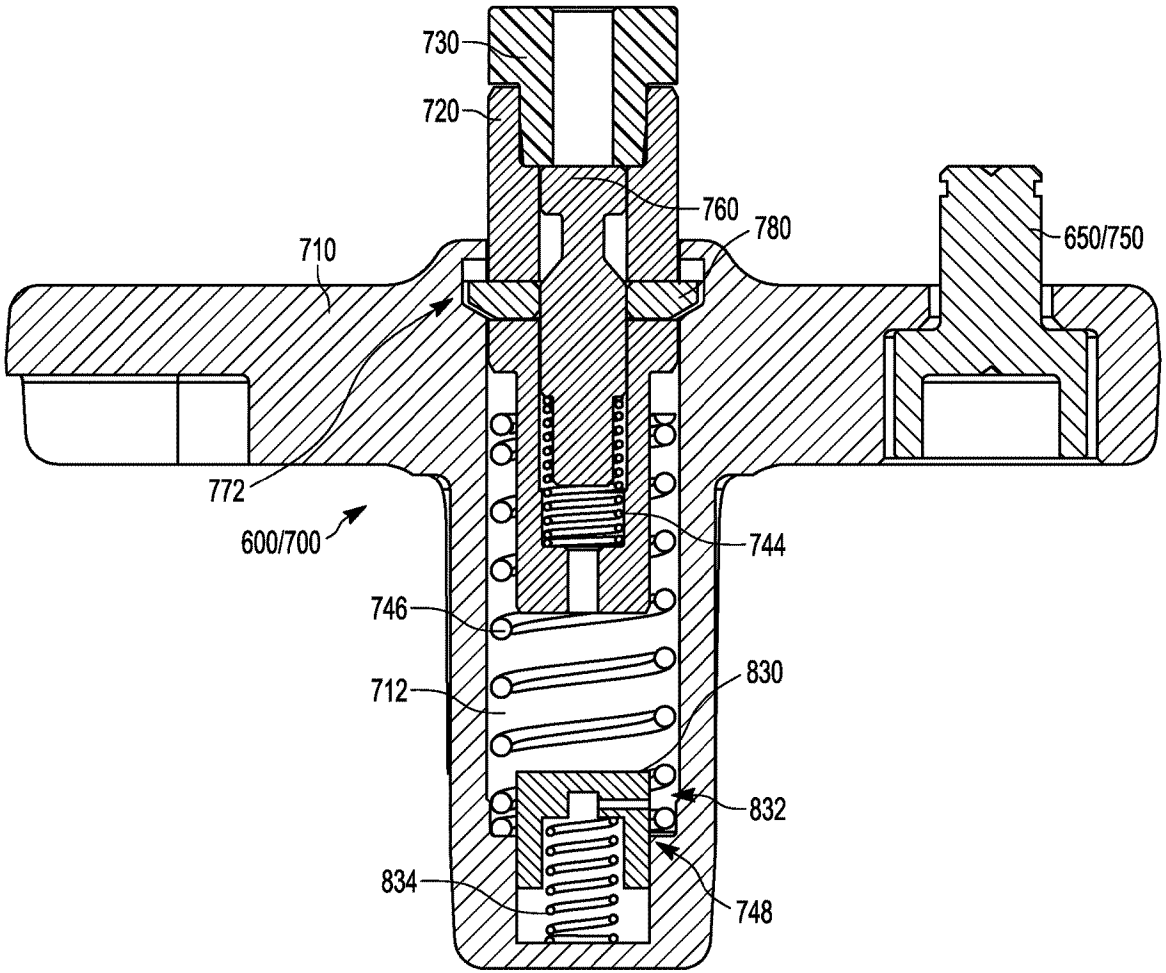
FIG. 25 is a schematic diagram in cross section illustrating a fifth alternative embodiment of the instant disclosure.

A fifth alternative embodiment of a valve train component 600/700 incorporating a lost motion system is illustrated in FIG. 25, in which like reference characters refer to like elements in other embodiments. It is noted that the embodiment shown in FIG. 25 may be operated in like fashion to those illustrated in FIGS. 1-24, none of the embodiments of which are considered to be limited to providing engine braking. The embodiment of FIG. 25 may provide any type of engine valve actuation that benefits from inclusion of a lost motion system.

The fifth alternative embodiment is essentially the same as that shown in FIGS. 10-11 except for the size and shape of the outer recess 772 and the addition of a snubber comprising a snubber piston 830. The outer recess 772 may be provided with a vertical dimension greater than the vertical dimension of the locking elements 780 (e.g., wedges) that they receive. The increased vertical dimension of the outer recess 772, as compared with that illustrated in FIGS. 10-11, may provide a larger travel distance along the longitudinal axis of the housing bore for the wedges 780 to register with the outer recess 772. It is appreciated that the increased vertical dimension of the outer recess 772 may be as much as twice, or even more than twice, the thickness (or vertical height) of the wedges 780 as measured along the longitudinal direction of the housing bore. As noted above, this additional space or gap between the outer recess 772 boundaries and the wedges 780 permits the lost motion assembly to maintain contact with the unlocking input even when the housing is moving during a locked state of the locking mechanism. As in embodiments described above, the outer recess 772 has a surface area that engages the wedges 780 which is sufficient to support the loading of the housing 710 for two valve opening events per engine cycle (2-cycle engine braking). It is noted that this modification of the size and shape of the female cone recesses 772 may be used in other embodiments described herein.

In the embodiment shown in FIG. 25, the snubber piston 830 may be cup shaped and be slidably disposed in the bottom portion of the housing bore 712 below the outer plunger 720. The snubber piston 830 may have an outer diameter that closely fits the diameter of the bottom portion of the housing bore 712 so as to permit a hydraulic seal to be formed between the two. A spring 834 may bias the snubber piston 830 towards the outer plunger 720.

The snubber piston 830 may have one or more side passages 832 which selectively permit hydraulic fluid to flow between the interior of the snubber piston 830 and the housing bore 712. In the embodiment shown in FIG. 25, two side passages 832 are shown to be vertically separated. The spring 834 may bias the snubber piston 830 sufficiently upwards towards the outer plunger 720 such that the lowest most side passage is above a shoulder 748 formed in the housing bore 712 and in hydraulic communication with the housing bore 712 when the snubber piston 830 is in its upper most position (as shown).

During operation of the system illustrated in FIG. 25, hydraulic fluid may be provided to displace the inner plunger 760 downward, as described above, to unlock the outer plunger 720 from the housing 710. As a result the outer plunger 720 may descend rapidly into the housing bore 712 until it encounters the snubber piston 830. As the outer plunger 720 descends, clearance between the outer plunger 720 and housing 710, i.e., leakage passages, permits some hydraulic fluid within the housing bore 712 to escape. Additionally, prior to encountering the snubber piston 830 the hydraulic fluid displaced by the downward movement of the outer plunger 720 passes through the one or more side openings 832 into the interior of the snubber piston 830. Once the outer plunger 720 contacts the snubber piston 830, the continued downward motion of the outer plunger 720 may be progressively arrested by the snubber piston 830 as a result of being displaced downward by the outer plunger. More specifically, the location and/or size of the one or more side passages 832 in the snubber piston 830 may be provided such that hydraulic communication between the interior of the snubber piston 830 and the housing bore 712 of the interior of the valve bridge body 710 is selectively, and in some instances progressively, cut off by the shoulder 748 provided on the interior wall of the valve bridge body 710. As a result of the relative incompressibility of the hydraulic fluid trapped between the snubber piston 830 and the housing 710, the snubber piston 830 may cushion the downward movement of the outer plunger 720 relative to the housing 710 when the two are unlocked from each other, as described in connection with the embodiments illustrated by FIGS. 1-24. When the outer plunger 720 moves away from the snubber piston 830 (i.e., per the bias applied by the outer plunger spring 746 when motion is not applied to the lost motion assembly), expansion of the volume between the outer plunger 720 and the snubber piston 830 may tend to draw the hydraulic fluid out of the cavity between the snubber piston 830 and the housing 710, which hydraulic fluid is then available for further transfer back into and out of the snubber piston 830 for subsequent events.

Figure 26:
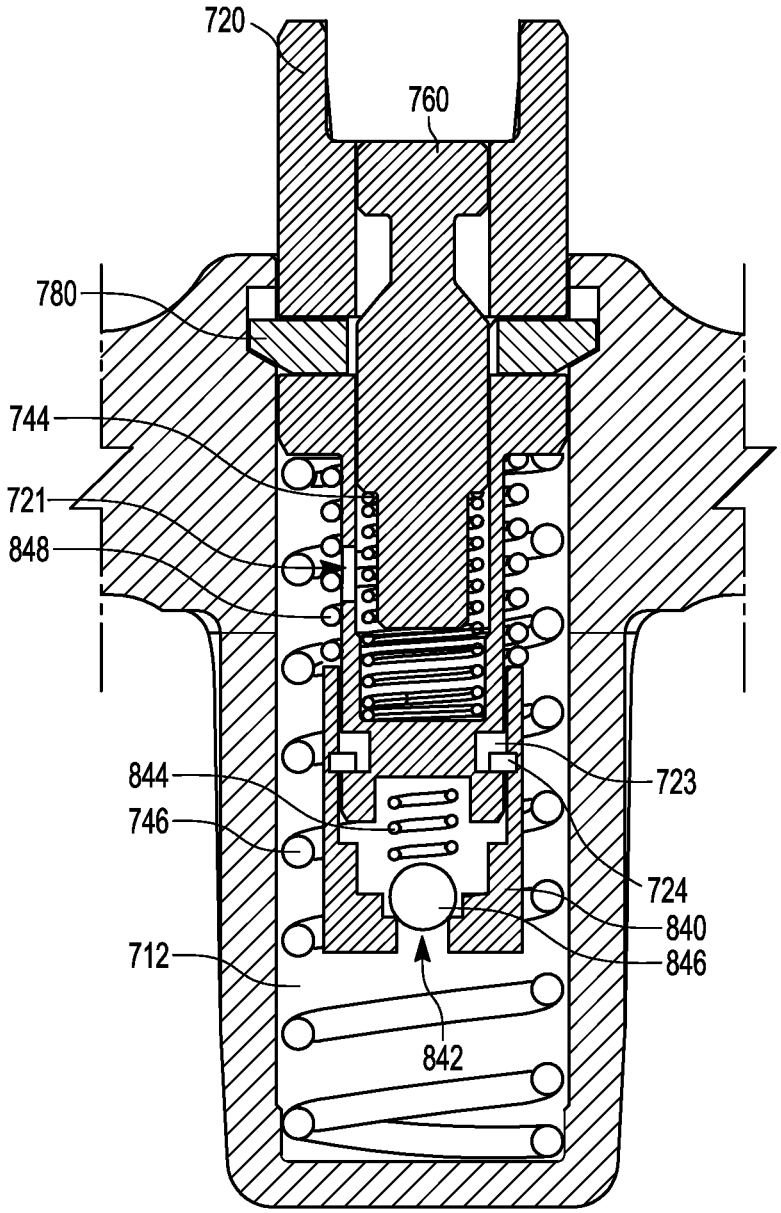
FIG. 26 is a schematic diagram in cross section illustrating a sixth alternative embodiment of the instant disclosure.

A sixth alternative embodiment of a valve train component 600/700 incorporating a lost motion system is illustrated in FIG. 26 in which like reference characters refer to like elements in other embodiments. The embodiment shown in FIG. 26 differs from that shown in FIG. 21 mainly with respect to the design of the snubber. In FIG. 26, the outer plunger 720 may include one or more side passages 721 which permit hydraulic fluid to flow between the interior of the outer plunger 720 and the housing bore 712. As before, the inner plunger spring 744 may be provided in the interior of the outer plunger 720 to bias the inner plunger 760 upward into a position that results in the locking elements 780 engaging the outer recess 772, as shown in FIG. 26.

The outer plunger 720 may further include a lower annulus 723 which receives a lock ring 724 used to connect a snubber piston 840 to the bottom of the outer plunger 720. The lower annulus 723 may be sized so as to permit some vertical movement of the snubber piston 840 relative to the outer plunger 720 while at the same time limiting the extent of such movement.

The snubber piston 840 may be biased away from the outer plunger 720 by springs 844 and 848. The spring 848 may extend from a shoulder formed at a mid-section of the outer plunger 720 to an upper edge of the snubber piston 840. It is appreciated that the upper edge of the snubber piston 840 may include a recess, shoulder, or other structure which receives the spring 848 and keeps it engaged against the snubber piston upper edge. The spring 844 may also bias a check valve 846 into a closed position against a seat formed by an opening 842 provided in the bottom of the snubber piston 840.

During operation of the system illustrated in FIG. 26, an unlocking input (e.g., hydraulic fluid) may be provided to displace the inner plunger 760 downward, as described above, to unlock the outer plunger 720 from the housing 710. The descent of the inner plunger 760 into the interior of the outer plunger 720 may cause some hydraulic fluid to be displaced from the interior of the outer plunger through the side opening 721 and into the housing bore 712. At the same time, the outer plunger 720 may descend rapidly into the housing bore 712 toward the bottom end wall of the housing 710. As a result of the movement of the outer plunger 720 and the inner plunger 760, hydraulic fluid may be forced through the opening 842 in the snubber piston 840, as well as out of the housing 710 through leakage passages. Due to the presence of the check valve 846, the interior of the snubber piston 840 may fill with hydraulic fluid. The pressurization of the snubber piston 840 interior may cause the snubber piston 840 to assume its maximum downward displacement relative to the outer plunger 720, as shown in FIG. 26

The outer plunger 720 may then carry the snubber piston 840 downward until the snubber piston contacts the bottom end wall of the housing 710. The downward motion of the outer plunger 720 may be progressively arrested by the snubber piston 840 as a result of the snubber piston being pushed upward by the housing 710 end wall. More specifically, the upward movement of the snubber piston causes the hydraulic fluid within it to be displaced through a small gap in diameters between the snubber piston 840 and the outer plunger 720. The size of the gap between the snubber piston 840 and the outer plunger 720 throttles fluid flow and arrests the downward movement of the outer plunger progressively. As a result, the snubber piston 840 may cushion the downward movement of the outer plunger 720 relative to the housing 710 when the two are unlocked from each other, as described in connection with the embodiments illustrated by FIGS. 1-24.

Figure 27:
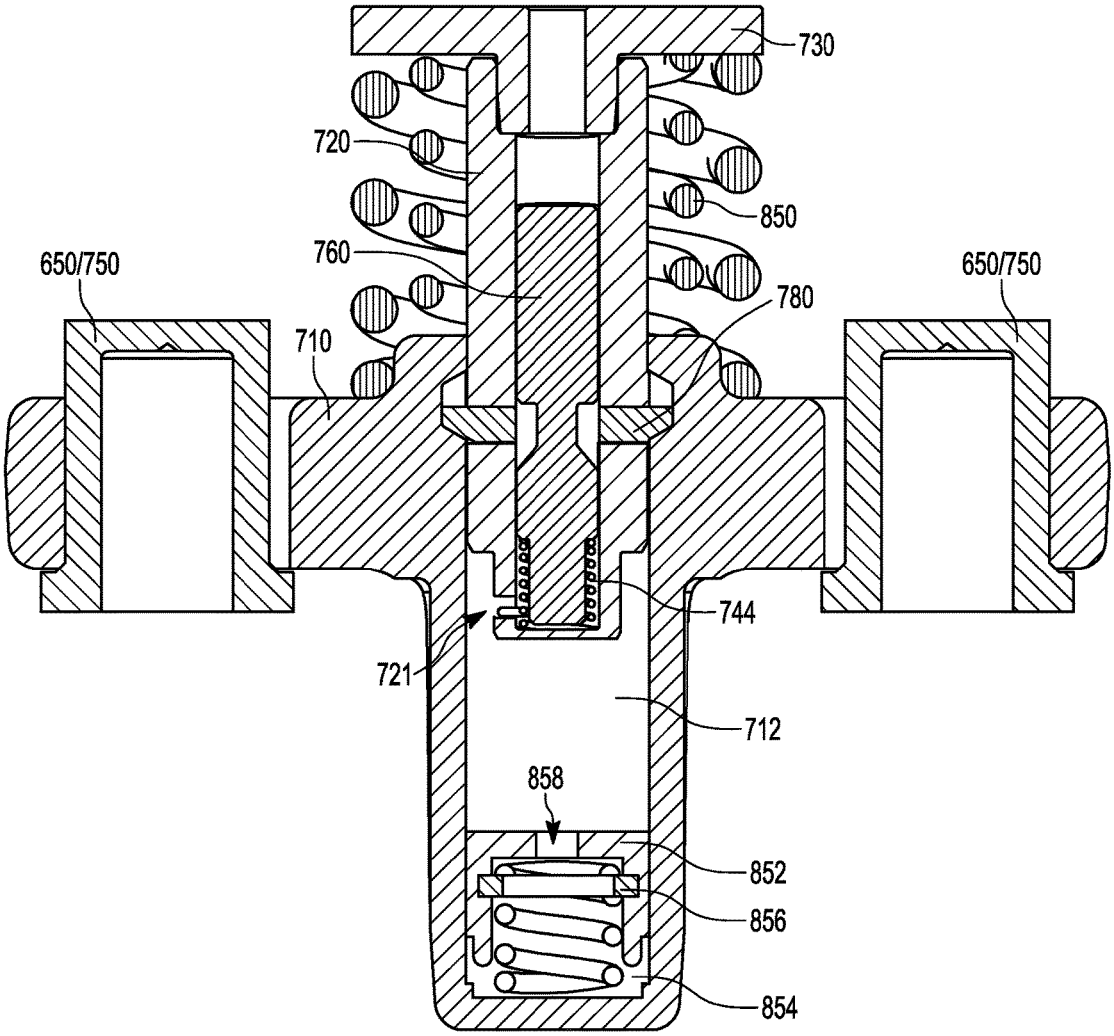
FIG. 27 is a schematic diagram in cross section illustrating a seventh alternative embodiment of the instant disclosure.

A seventh alternative embodiment of a valve train component 600/700 incorporating a lost motion system is illustrated in FIG. 27 in which like reference characters refer to like elements in other embodiments. The embodiment shown in FIG. 27 differs from that shown in FIG. 25 in the following manner. In FIG. 27, the outer plunger 720 may include one or more side passages 721 which permit hydraulic fluid to flow between the interior of the outer plunger 720 and the housing bore 712 of the housing 710. The inner plunger spring 744 may be provided in the interior of the outer plunger 720 to bias the inner plunger 760 upward into a position that results in the locking elements 780 engaging the outer recess 772, as shown in FIG. 27.

With continued reference to FIG. 27, a cap 730 may be connected to the upper end of the outer plunger 720. One or more heavy springs 850 may act on the cap 730 to bias the housing 710 downward relative to the outer plunger 720. The one or more heavy springs 850 may assist in arresting the downward motion of the outer plunger 720 relative to the valve body 710 when the two are unlocked from each other, as explained in detail below.

The snubber shown in FIG. 27 includes a snubber piston 852 that may be cup-shaped and have an upper opening 858 that permits hydraulic fluid to flow between the interior of the snubber piston 852 and the housing bore 712. A spring 854 may bias the snubber piston 852 towards the outer plunger 720. The spring 854 may be connected to the snubber piston 852 by a lock ring 856. The embodiment shown in FIG. 27 may also include sliding pins 650/750 for each of two valve stems.

During operation of the system illustrated in FIG. 27, an unlocking input (e.g., hydraulic fluid) may be provided to displace the inner plunger 760 downward, as described above, to unlock the outer plunger 720 from the housing 710. The descent of the inner plunger 760 into the interior of the outer plunger 720 may cause some hydraulic fluid to be displaced from the interior of the outer plunger through the side opening 721 and into the housing bore 712. At the same time, the outer plunger 720 may descend rapidly into the housing bore 712 toward the snubber piston 852. As a result of the movement of the outer plunger 720 and the inner plunger 760, hydraulic fluid may be forced through the opening 858 in the snubber piston 852, as well as out of the valve body 710 through leakage passages.

Once the outer plunger 720 contacts the snubber piston 852, the continued downward motion of the outer plunger 720 may be progressively arrested by the snubber piston as a result of the snubber piston being displaced downward by the outer plunger. More specifically, the location and/or size of the opening 858 in the snubber piston 852 may be provided such that hydraulic communication between the interior of the snubber piston 852 and the housing bore 712 of the valve bridge body 710 is selectively, and in some instances progressively, cut off. As a result, the snubber piston 852, in concert with the one or more heavy springs 850, may cushion the downward movement of the outer plunger 720 relative to the valve bridge body 710 when the two are unlocked from each other, as described in connection with the embodiments illustrated by FIGS. 1-24.

Figure 28:
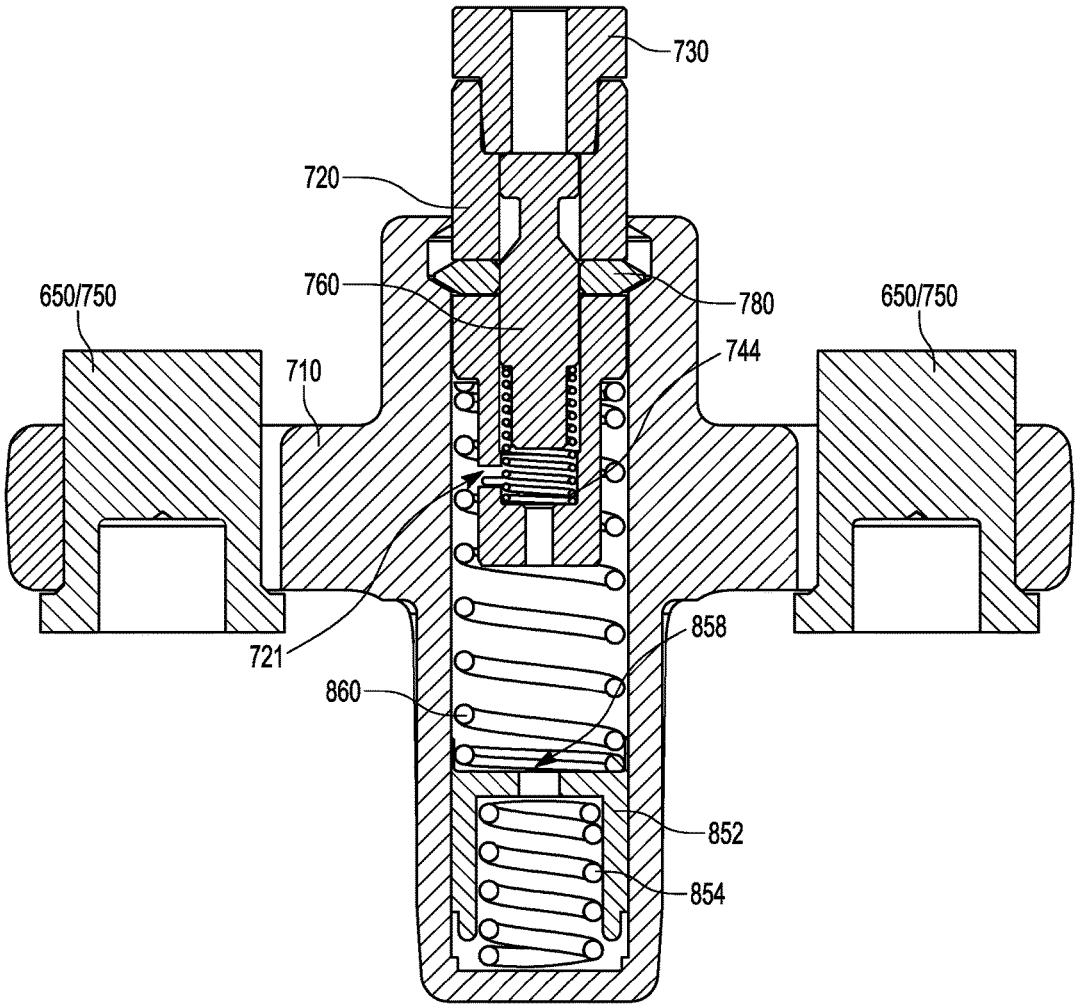
FIG. 28 is a schematic diagram in cross section illustrating an eighth alternative embodiment of the instant disclosure.

A eighth alternative embodiment of a valve train component 600/700 incorporating a lost motion system is illustrated in FIG. 28 in which like reference characters refer to like elements in other embodiments. The embodiment shown in FIG. 28 differs from that shown in FIG. 27 mainly with respect to the location of the spring(s) used to bias the outer plunger 720 relative to the housing 710. In FIG. 28, a spring 860 is provided within the housing 710 as opposed to above it. The spring 860 biases the outer plunger 720 upward relative to the housing 710 and the snubber piston 852.

During operation of the system illustrated in FIG. 28, hydraulic fluid may be provided to displace the inner plunger 760 downward to unlock the outer plunger 720 from the housing 710. The descent of the inner plunger 760 into the interior of the outer plunger 720 may cause some hydraulic fluid to be displaced from the interior of the outer plunger through the side opening 721 and into the housing bore 712. At the same time, the outer plunger 720 may descend rapidly into the housing bore 712 toward the snubber piston 852. As a result of the movement of the outer plunger 720 and the inner plunger 760, hydraulic fluid may be forced through the opening 858 in the snubber piston 852, as well as out of the housing 710 through leakage passages.

In the embodiment of FIG. 28, movement of the snubber piston 852 is controlled in part the relative forces applied by the springs 860, 854. In particular, the springs 860, 854 engaging the snubber piston 852 are configured to have the same force at approximately the mid-stroke of the outer plunger 720 relative to the housing 710. As the outer plunger 720 continues to descend within the housing 710, the force from the first spring 860 increases to the point that it becomes greater than the opposing force applied by the second spring 854, thereby pushing the snubber piston 852 downwards. The downwards velocity of the snubber piston 852 is controlled by the force difference between the springs 860, 854 and the hydraulic force due to pressure difference caused by oil flowing through the opening 858. Consequently, for a normal valve event and in which the locking mechanism is already in an unlocked state, downward travel of the outer plunger 720 will cause the snubber piston 852 to reach the bottom of its stroke (i.e., abutting the bottom wall of the housing 710) prior to the outer plunger 720 reaching its bottom-most position.

It can be anticipated, however, that there will be instances where the locking mechanism will be switched from a locked state to an unlocked state during a relatively high-lift valve event. In this case, the outer plunger 720 will release rapidly, thereby causing the first spring 860 to likewise compress rapidly. As a consequence, there would be insufficient time for the snubber piston 852 to travel downward to avoid impact with the outer plunger 720. However, as the outer plunger 720 contacts the snubber piston 852, it will obstruct the opening 858 thereby further pressurizing the hydraulic fluid trapped by the snubber piston 852. As described above relative to the other embodiments described herein, this results in a significant slowing force being applied to the outer plunger 720 that, in turn, prevents the further rapid collapse of the outer plunger 720 and resulting noise that would have occurred without the presence of the snubber piston 852.

It will be apparent to those skilled in the art that variations and modifications of the instant disclosure can be made without departing from the scope or spirit of the invention. For example, the means for actuating an exhaust valve to provide engine braking 100 and the means for actuating an intake valve to provide engine braking 300 may provide non-engine braking valve actuations in other applications.

In another example, various modifications to the locking elements and corresponding outer recess may be used. For instance, in the case of a wedge-type implementation, the inclined surfaces of the wedge and or outer recess may be defined according to a non-conical surface. Furthermore, rather than comprising an annular channel around the entire circumference of the surface defining housing bore, the outer recess could comprise one or more slots (otherwise unconnected to each other) configured to align with and receive respective ones of the one or more wedges. Alternatively, but in this same vein, the locking elements could comprise one or more pins received in corresponding holes aligned therewith and formed in the surface defining housing bore.

In yet another example, while the various snubbers described above include snubber pistons and associated components, it may be possible to implement a snubber based solely on the provision of designed leakage passages between various ones of the components of the locking mechanism, e.g., between the outer plunger and the housing. In this fashion, the function of the snubber is provided solely by the flow of hydraulic fluid through the clearance provided between the housing the locking mechanism. Furthermore, while the various embodiments described herein in which a locking mechanism is combined with a snubber have been described in the context of a specific type of valve train component (i.e., a valve bridge), it is appreciated that such a locking mechanism/snubber combination may be incorporated into any valve train component, including the various other embodiments described herein.

While particular preferred embodiments have been shown and described, those skilled in the art will appreciate that changes and modifications may be made without departing from the instant teachings. It is therefore contemplated that any and all modifications, variations or equivalents of the above-described teachings fall within the scope of the basic underlying principles disclosed above and claimed herein.

What is claimed is:

1. In an internal combustion engine comprising a valve train for actuating one or more engine valves, a device for controlling motion applied to the one or more engine valves, comprising:

an housing disposed within the valve train, the housing having an housing bore extending into the housing and an outer recess formed in a surface defining the housing bore, the outer recess comprising an outer recess inclined surface defined according to a cone frustum; and a locking mechanism disposed in the housing bore and comprising a wedge, the wedge comprising a wedge inclined surface defined according to the cone frustum and configured to mate with the outer recess inclined surface, wherein interaction of the wedge inclined surface with the outer recess inclined surface urges withdrawal of the wedge from the outer recess and unlocking of the locking mechanism thereby preventing application of motion to the one or more engine valves via the device.

2. The device of claim 1, wherein the locking mechanism further comprises:

an outer plunger slidably disposed in the housing bore, said outer plunger having an interior bore defining an outer plunger side wall, and a side opening extending through the outer plunger side wall, wherein the wedge is disposed in the outer plunger side opening; and an inner plunger slidably disposed in the outer plunger interior bore, said inner plunger having an inner recess formed therein configured to receive the wedge.

3. The device of claim 2, the outer plunger comprising an unlocking opening configured to receive an unlocking input, wherein the unlocking input causes the inner plunger to slide within the outer plunger thereby permitting the wedge to be received in the inner recess.

4. The device of claim 3, wherein the unlocking opening is disposed at an end of the outer plunger and is configured to receive hydraulic fluid as the unlocking input.

5. The device of claim 4, wherein the outer plunger is received in an open end of the housing bore and the unlocking opening is an open end of the outer plunger.

6. The device of claim 3, wherein the housing comprises a lateral opening configured for fluid communication with the housing bore and the unlocking opening, and further configured to receive hydraulic fluid as the unlocking input.

7. The device of claim 2, further comprising:

a snubber, disposed in the housing bore between the outer plunger and the housing, configured to progressively arrest movement of the outer plunger.

8. The device of claim 1, wherein the housing is provided by a valve bridge, a rocker arm, a push tube or a cam follower.

9. The device of claim 1, wherein the housing is provided between a push tube and a rocker arm or between the rocker arm and an engine valve.

10. The device of claim 9, wherein the housing is a cartridge insert configured for mounting on either the push tube or the rocker arm.

11. The device of claim 1, wherein the outer recess has a vertical height greater than a vertical height of the wedge.

12. The device of claim 11, wherein the outer recess has a vertical height not greater than twice the vertical height of the wedge.

13. The device of claim 11, wherein the outer recess has a vertical height greater than twice the vertical height of the wedge.

14. The device of claim 1, wherein the wedge comprises a second wedge inclined surface defined according to the cone frustum, the second wedge inclined surface disposed on a side of the wedge opposite the wedge inclined surface.

15. In an internal combustion engine comprising a valve train for actuating one or more engine valves, a device for controlling motion applied to the one or more engine valves, comprising:

an housing disposed within the valve train, the housing having an housing bore extending into the housing;

a locking mechanism disposed in the housing bore, a locked state of the locking mechanism permitting application of motion to the one or more engine valves via the device and an unlocked state of the locking mechanism preventing application of motion to the one or more engine valves via the device; and a snubber, disposed in the housing bore between the locking mechanism and the housing and in communication with the locking mechanism, configured to progressively arrest movement of at least a portion of the locking mechanism through controlled flow of hydraulic fluid.

16. The device of claim 15, wherein the locking mechanism comprises an hydraulically-actuated locking mechanism.

17. The device of claim 16, wherein the snubber is in fluid communication with the hydraulically-actuated locking mechanism.

18. The device of claim 15, wherein the locking mechanism further comprises:

an outer plunger slidably disposed in the housing bore, said outer plunger having an interior bore defining an outer plunger side wall, and a side opening extending through the outer plunger side wall;

an inner plunger slidably disposed in the outer plunger interior bore, said inner plunger having an inner recess formed therein; and a locking element disposed in the side opening of the outer plunger side wall, wherein the locking element is configured to engage an outer recess formed in a surface defining the housing bore, and wherein the inner recess is configured to receive the locking element.

19. The device of claim 18, wherein the locking element comprises a wedge.

20. The device of claim 18, the outer plunger comprising an unlocking opening configured to receive an unlocking input, wherein the unlocking input causes the inner plunger to slide within the outer plunger thereby permitting the wedge to be received in the inner recess.

21. The device of claim 20, wherein the unlocking opening is disposed at an end of the outer plunger and is configured to receive hydraulic fluid as the unlocking input.

22. The device of claim 21, wherein the outer plunger is received in an open end of the housing bore and the unlocking opening is at an end of the outer plunger proximate the open end of the housing bore.

23. The device of claim 20, wherein the housing comprises a lateral opening configured for fluid communication with the housing bore and the unlocking opening, and further configured to receive hydraulic fluid as the unlocking input.

24. The device of claim 18, wherein the snubber comprises a snubber piston disposed on the outer plunger.

25. The device of claim 15, wherein the housing is provided by a valve bridge, a rocker arm, a push tube or a cam follower.

26. The device of claim 15, wherein the housing is provided between a push tube and a rocker arm or between the rocker arm and an engine valve.

27. The device of claim 26, wherein the housing is a cartridge insert configured for mounting on either the push tube or the rocker arm.

28. The device of claim 15, wherein the snubber comprises a snubber piston disposed in the housing bore.

29. The device of claim 28, wherein the snubber piston is cup-shaped and includes one or more side passages extending through a wall of the snubber piston.

30. The device of claim 28, further comprising a check valve disposed within the snubber piston.

31. In an internal combustion engine comprising a valve train for actuating one or more engine valves, a device for controlling motion applied to the one or more engine valves, comprising:

an housing disposed within the valve train, the housing having a housing bore extending into the housing and an outer recess formed in a surface defining the housing bore; and a locking mechanism disposed in the housing bore and comprising a locking element, wherein the locking element engages the outer recess in a locked state of the locking mechanism thereby permitting application of motion to one or more engine valves via the device, wherein the outer recess is configured to permit movement of the locking element along a longitudinal axis of the housing bore when the locking element engages the outer recess.

32. The device of claim 31, wherein the outer recess has a vertical height greater than a vertical height of the locking element.

33. The device of claim 32, wherein the outer recess has a vertical height not greater than twice the vertical height of the locking element.

34. The device of claim 32, wherein the outer recess has a vertical height greater than twice the vertical height of the locking element.

35. The device of claim 31, wherein the locking element comprises a wedge.

36. The device of claim 31, wherein the locking mechanism further comprises:

an outer plunger slidably disposed in the housing bore, said outer plunger having an interior bore defining an outer plunger side wall, and a side opening extending through the outer plunger side wall;

an inner plunger slidably disposed in the outer plunger interior bore, said inner plunger having an inner recess formed therein; and wherein locking element disposed in the side opening of the outer plunger side wall, and wherein the inner recess is configured to receive the locking element.

37. The device of claim 36, the outer plunger comprising an unlocking opening configured to receive an unlocking input, wherein the unlocking input causes the inner plunger to slide within the outer plunger thereby permitting the locking element to be received in the inner recess.

38. The device of claim 37, wherein the unlocking opening is disposed at an end of the outer plunger and is configured to receive hydraulic fluid as the unlocking input.

39. The device of claim 38, wherein the outer plunger is received in an open end of the housing bore and the unlocking opening is at an end of the outer plunger proximate the open end of the housing bore.

40. The device of claim 37, wherein the housing comprises a lateral opening configured for fluid communication with the housing bore and the unlocking opening, and further configured to receive hydraulic fluid as the unlocking input.

41. The device of claim 31, wherein the housing is provided by a valve bridge, a rocker arm, a push tube or a cam follower.

42. The device of claim 31, wherein the housing is provided between a push tube and a rocker arm or between the rocker arm and an engine valve.

43. The device of claim 42, wherein the housing is a cartridge inert configured for mounting on either the push tube or the rocker arm.

* * * * *